US009963955B2

(12) United States Patent
Tolman et al.

(10) Patent No.: US 9,963,955 B2
(45) Date of Patent: May 8, 2018

(54) ASSEMBLY AND METHOD FOR MULTI-ZONE FRACTURE STIMULATION OF A RESERVOIR USING AUTONOMOUS TUBULAR UNITS

(71) Applicants: Randy C. Tolman, Spring, TX (US); Pavlin B. Entchev, Houston, TX (US); Renzo M. Angeles Boza, Houston, TX (US); Dennis H. Petrie, Sugarland, TX (US); Kevin H. Searles, Kingwood, TX (US); Abdel Wadood M. El-Rabaa, Plano, TX (US)

(72) Inventors: Randy C. Tolman, Spring, TX (US); Pavlin B. Entchev, Houston, TX (US); Renzo M. Angeles Boza, Houston, TX (US); Dennis H. Petrie, Sugarland, TX (US); Kevin H. Searles, Kingwood, TX (US); Abdel Wadood M. El-Rabaa, Plano, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 128 days.

(21) Appl. No.: 15/013,759

(22) Filed: Mar. 2, 2016

(65) Prior Publication Data

US 2016/0168962 A1 Jun. 16, 2016

Related U.S. Application Data

(63) Continuation of application No. 13/697,769, filed as application No. PCT/US2011/038202 on May 26, 2011, now Pat. No. 9,284,819.

(Continued)

(51) Int. Cl.
*E21B 29/02* (2006.01)
*E21B 43/1185* (2006.01)

(Continued)

(52) U.S. Cl.
CPC ..... *E21B 43/119* (2013.01); *E21B 23/00* (2013.01); *E21B 33/134* (2013.01); *E21B 41/00* (2013.01);

(Continued)

(58) Field of Classification Search
CPC ..... E21B 29/02; E21B 43/11; E21B 43/1185; E21B 43/119; E21B 47/09

(Continued)

(56) References Cited

U.S. PATENT DOCUMENTS 3,187,815 A 6/1965 Ownby
4,194,561 A 3/1980 Stokley et al.

(Continued)

*Primary Examiner* — Kenneth L Thompson
(74) *Attorney, Agent, or Firm* — ExxonMobil Upstream Research Company—Law Department

(57) ABSTRACT

Autonomous units and methods for downhole, multi-zone perforation and fracture stimulation for hydrocarbon production. The autonomous unit may be a perforating gun assembly, a bridge plug assembly, or fracturing plug assembly. The autonomous units are dimensioned and arranged to be deployed within a wellbore without an electric wireline. The autonomous units may be fabricated from a friable material so as to self-destruct upon receiving a signal. The autonomous units include a position locator for sensing the presence of objects along the wellbore and generating depth signals in response. The autonomous units also include an on-board controller for processing the depth signals and for activating an actuatable tool at a zone of interest.

16 Claims, 30 Drawing Sheets

Related U.S. Application Data

(60) Provisional application No. 61/348,578, filed on May 26, 2010.

(51) Int. Cl.

| | |
|---|---|
| ***E21B 43/119*** | (2006.01) |
| ***E21B 23/00*** | (2006.01) |
| ***E21B 33/134*** | (2006.01) |
| ***E21B 43/26*** | (2006.01) |
| ***E21B 41/00*** | (2006.01) |
| ***E21B 43/116*** | (2006.01) |
| ***E21B 47/09*** | (2012.01) |

(52) U.S. Cl.
CPC ..... *E21B 43/116* (2013.01); *E21B 43/26* (2013.01); *E21B 47/09* (2013.01)

(58) Field of Classification Search
USPC .... 166/250.01, 255.1, 297, 55, 55.1, 63, 64, 166/66, 376
See application file for complete search history.

(56) References Cited

U.S. PATENT DOCUMENTS

| | | | |
|---|---|---|---|
| 4,339,000 | A | 7/1982 | Cronmiller |
| 4,778,009 | A | 10/1988 | Sumner et al. |
| 5,909,774 | A | 6/1999 | Griffith et al. |
| 6,056,055 | A | 5/2000 | Falconer et al. |
| 6,378,627 | B1 | 4/2002 | Tubel et al. |
| 6,394,184 | B2 | 5/2002 | Tolman et al. |
| 6,513,599 | B1 | 2/2003 | Bixenman et al. |
| 6,543,538 | B2 | 4/2003 | Tolman et al. |
| 6,581,689 | B2 | 6/2003 | Hailey, Jr. |
| 6,601,646 | B2 | 8/2003 | Streich et al. |
| 6,752,206 | B2 | 6/2004 | Watson et al. |
| 6,779,605 | B2 | 8/2004 | Jackson |
| 6,789,623 | B2 | 9/2004 | Hill, Jr. et al. |
| 6,817,410 | B2 | 11/2004 | Wetzel et al. |
| 6,830,104 | B2 | 12/2004 | Nguyen et al. |
| 6,843,317 | B2 | 1/2005 | Mackenzie |
| 6,935,432 | B2 | 8/2005 | Nguyen |
| 6,983,796 | B2 | 1/2006 | Bayne et al. |
| 6,997,263 | B2 | 2/2006 | Campbell et al. |
| 7,055,598 | B2 | 6/2006 | Ross et al. |
| 7,096,945 | B2 | 8/2006 | Richards et al. |
| 7,100,691 | B2 | 9/2006 | Nguyen et al. |
| 7,252,142 | B2 | 8/2007 | Brezinski et al. |
| 7,264,061 | B2 | 9/2007 | Dybevik et al. |
| 7,322,416 | B2 | 1/2008 | Burris, II |
| 7,325,616 | B2 | 2/2008 | Lopez de Cardenas et al. |
| 7,363,967 | B2 | 4/2008 | Burris, II et al. |
| 7,367,395 | B2 | 5/2008 | Vidrine et al. |
| 7,385,523 | B2 | 6/2008 | Thomeer et al. |
| 7,407,007 | B2 | 8/2008 | Tibbles |
| 7,431,085 | B2 | 10/2008 | Coronado et al. |
| 7,431,098 | B2 | 10/2008 | Ohmer et al. |
| 7,441,604 | B2 | 10/2008 | Coronado et al. |
| 7,562,709 | B2 | 7/2009 | Saebi et al. |
| 7,591,321 | B2 | 9/2009 | Whitsitt et al. |
| 7,703,507 | B2 | 4/2010 | Strickland |
| 7,814,970 | B2 | 10/2010 | Strickland |
| 8,037,934 | B2 | 10/2011 | Strickland |
| 8,157,022 | B2 | 4/2012 | Bertoja |
| 8,162,051 | B2 | 4/2012 | Strickland |
| 8,272,439 | B2 | 9/2012 | Strickland |
| 2002/0093431 | A1 | 7/2002 | Zierolf |
| 2004/0007829 | A1 | 1/2004 | Ross |
| 2004/0221993 | A1 | 11/2004 | Patterson et al. |
| 2005/0241824 | A1 | 11/2005 | Burris, II et al. |
| 2005/0241835 | A1 | 11/2005 | Burris, II |
| 2005/0263287 | A1 | 12/2005 | Achee, Jr. et al. |
| 2005/0269083 | A1 | 12/2005 | Burris, II |
| 2007/0056750 | A1 | 3/2007 | John et al. |
| 2008/0053658 | A1 | 3/2008 | Wesson et al. |
| 2008/0125335 | A1 | 5/2008 | Bhaysar |
| 2008/0142222 | A1 | 6/2008 | Howard et al. |
| 2008/0196896 | A1 | 8/2008 | Bustos et al. |
| 2008/0257546 | A1 | 10/2008 | Cresswell et al. |
| 2009/0084556 | A1 | 4/2009 | Richards et al. |
| 2009/0114392 | A1 | 5/2009 | Tolman et al. |
| 2009/0120637 | A1 | 5/2009 | Kirkwood et al. |
| 2009/0159279 | A1 | 6/2009 | Assal |
| 2009/0248307 | A1 | 10/2009 | Barrow et al. |
| 2009/0283279 | A1 | 11/2009 | Patel et al. |
| 2009/0301723 | A1 | 12/2009 | Gray |
| 2011/0035152 | A1 | 2/2011 | Durocher et al. |

ASSEMBLY AND METHOD FOR MULTI-ZONE FRACTURE STIMULATION OF A RESERVOIR USING AUTONOMOUS TUBULAR UNITS

CROSS-REFERENCE TO RELATED APPLICATION

This application is a continuation of and claims priority to U.S. patent application Ser. No. 13/697,769, filed Nov. 13, 2012 which is a 371 National Stage Application of International Application No. PCT/US11/38202, filed May 26, 2011, which claims the benefit of U.S. Provisional Patent Application 61/348,578, filed May 26, 2010, entitled ASSEMBLY AND METHOD FOR MULTI-ZONE FRACTURE STIMULATION OF A RESERVOIR USING AUTONOMOUS TUBULAR UNITS, the entirety of which are incorporated by reference herein. This application is also related to previously filed PCT application (PCT/US2011/031948) entitled ASSEMBLY AND METHOD FOR MULTI-ZONE FRACTURE STIMULATION OF A RESERVOIR USING AUTONOMOUS TUBULAR UNITS, filed Apr. 11, 2011.

FIELD OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

BACKGROUND

This invention relates generally to the field of perforating and treating subterranean formations to enable the production of oil and gas therefrom. More specifically, the invention provides a method for perforating, isolating, and treating one interval or multiple intervals sequentially without need of a wireline or other running string.

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with cement. This serves to form a cement sheath. The combination of cement and casing strengthens the wellbore and facilitates the isolation of the formations behind the casing.

It is common to place several strings of casing having progressively smaller outer diameters into the wellbore. Thus, the process of drilling and then cementing progressively smaller strings of casing is repeated several or even multiple times until the well has reached total depth. The final string of casing, referred to as a production casing, is cemented into place. In some instances, the final string of casing is a liner, that is, a string of casing that is not tied back to the surface, but is hung from the lower end of the preceding string of casing.

As part of the completion process, the production casing is perforated at a desired level. This means that lateral holes are shot through the casing and the cement sheath surrounding the casing to allow hydrocarbon fluids to flow into the wellbore. Thereafter, the formation is typically fractured.

Hydraulic fracturing consists of injecting viscous fluids (usually shear thinning, non-Newtonian gels or emulsions) into a formation at such high pressures and rates that the reservoir rock fails and forms a network of fractures. The fracturing fluid is typically mixed with a granular proppant material such as sand, ceramic beads, or other granular materials. The proppant serves to hold the fracture(s) open after the hydraulic pressures are released. The combination of fractures and injected proppant increases the flow capacity of the treated reservoir.

In order to further stimulate the formation and to clean the near-wellbore regions downhole, an operator may choose to "acidize" the formations. This is done by injecting an acid solution down the wellbore and through the perforations. The use of an acidizing solution is particularly beneficial when the formation comprises carbonate rock. In operation, the drilling company injects a concentrated formic acid or other acidic composition into the wellbore, and directs the fluid into selected zones of interest. The acid helps to dissolve carbonate material, thereby opening up porous channels through which hydrocarbon fluids may flow into the wellbore. In addition, the acid helps to dissolve drilling mud that may have invaded the formation.

Application of hydraulic fracturing and acid stimulation as described above is a routine part of petroleum industry operations as applied to individual target zones. Such target zones may represent up to about 60 meters (200 feet) of gross, vertical thickness of subterranean formation. When there are multiple or layered reservoirs to be hydraulically fractured, or a very thick hydrocarbon-bearing formation (over about 40 meters), then more complex treatment techniques are required to obtain treatment of the entire target formation. In this respect, the operating company must isolate various zones to ensure that each separate zone is not only perforated, but adequately fractured and treated. In this way the operator is sure that fracturing fluid and/or stimulant is being injected through each set of perforations and into each zone of interest to effectively increase the flow capacity at each desired depth.

The isolation of various zones for pre-production treatment requires that the intervals be treated in stages. This, in turn, involves the use of so-called diversion methods.

In petroleum industry terminology, "diversion" means that injected fluid is diverted from entering one set of perforations so that the fluid primarily enters only one selected zone of interest. Where multiple zones of interest are to be perforated, this requires that multiple stages of diversion be carried out.

In order to isolate selected zones of interest, various diversion techniques may be employed within the wellbore. Known diversion techniques include the use of:

- Mechanical devices such as bridge plugs, packers, downhole valves, sliding sleeves, and baffle/plug combinations;
- Ball sealers;
- Particulates such as sand, ceramic material, proppant, salt, waxes, resins, or other compounds;
- Chemical systems such as viscosified fluids, gelled fluids, foams, or other chemically formulated fluids; and
- Limited entry methods.

These and other methods for temporarily blocking the flow of fluids into or out of a given set of perforations are described more fully in U.S. Pat. No. 6,394,184 entitled "Method and Apparatus for Stimulation of Multiple Formation Intervals." The '184 patent issued in 2002 and was co-assigned to ExxonMobil Upstream Research Company. The '184 patent is referred to and incorporated herein by reference in its entirety.

The '184 patent also discloses various techniques for running a bottom hole assembly ("BHA") into a wellbore, and then creating fluid communication between the wellbore and various zones of interest. In most embodiments, the BHA's include various perforating guns having associated charges. The BHA's further include a wireline extending from the surface and to the assembly for providing electrical signals to the perforating guns. The electrical signals allow the operator to cause the charges to detonate, thereby forming perforations.

The BHA's also include a set of mechanically actuated, re-settable axial position locking devices, or slips. The illustrative slips are actuated through a "continuous J" mechanism by cycling the axial load between compression and tension. The BHA's further include an inflatable packer or other sealing mechanism. The packer is actuated by application of a slight compressive load after the slips are set within the casing. The packer is resettable so that the BHA may be moved to different depths or locations along the wellbore so as to isolate selected perforations.

The BHA also includes a casing collar locator. The casing collar locator allows the operator to monitor the depth or location of the assembly for appropriately detonating charges. After the charges are detonated (or the casing is otherwise penetrated for fluid communication with a surrounding zone of interest), the BHA is moved so that the packer may be set at a desired depth. The casing collar locator allows the operator to move the BHA to an appropriate depth relative to the newly formed perforations, and then isolate those perforations for hydraulic fracturing and chemical treatment.

Each of the various embodiments for a BHA disclosed in the '184 patent includes a means for deploying the assembly into the wellbore, and then translating the assembly up and down the wellbore. Such translation means include a string of coiled tubing, conventional jointed tubing, a wireline, an electric line, or a downhole tractor. In any instance, the purpose of the bottom hole assemblies is to allow the operator to perforate the casing along various zones of interest, and then sequentially isolate the respective zones of interest so that fracturing fluid may be injected into the zones of interest in the same trip.

Known well completion processes require the use of surface equipment. FIG. 1 presents a side view of a well site 100 wherein a well is being drilled. The well site 100 is using known surface equipment 50 to support wellbore tools (not shown) above and within a wellbore 10. The wellbore tools may be, for example, a perforating gun or a fracturing plug. In the illustrative arrangement of FIG. 1, the wellbore tools are suspended at the end of a wireline 85.

The surface equipment 50 first includes a lubricator 52. The lubricator 52 is an elongated tubular device configured to receive wellbore tools (or a string of wellbore tools), and introduce them into the wellbore 10. In general, the lubricator 52 must be of a length greater than the length of the perforating gun assembly (or other tool string) to allow the perforating gun assembly to be safely deployed in the wellbore 100 under pressure.

The lubricator 52 delivers the tool string in a manner where the pressure in the wellbore 10 is controlled and maintained. With readily-available existing equipment, the height to the top of the lubricator 52 can be approximately 100 feet from an earth surface 105. Depending on the overall length requirements, other lubricator suspension systems (fit-for-purpose completion/workover rigs) may also be used. Alternatively, to reduce the overall surface height requirements, a downhole lubricator system similar to that described in U.S. Pat. No. 6,056,055 issued May 2, 2000 may be used as part of the surface equipment 50 and completion operations.

The lubricator 52 is suspended over the wellbore 10 by means of a crane arm 54. The crane arm 54 is supported over the earth surface 105 by a crane base 56. The crane base 56 may be a working vehicle that is capable of transporting part or the entire crane arm 54 over a roadway. The crane arm 54 includes wires or cables 58 used to hold and manipulate the lubricator 52 into and out of position over the wellbore 10. The crane arm 54 and crane base 56 are designed to support the load of the lubricator 52 and any load requirements anticipated for the completion operations.

In the view of FIG. 1, the lubricator 52 has been set down over a wellbore 10. An upper portion of an illustrative wellbore 10 is shown in FIG. 1. The wellbore 10 defines a bore 5 that extends from the surface 105 of the earth, and into the earth's subsurface 110.

The wellbore 10 is first formed with a string of surface casing 20. The surface casing 20 has an upper end 22 in sealed connection with a lower master fracture valve 25. The surface casing 20 also has a lower end 24. The surface casing 20 is secured in the wellbore 10 with a surrounding cement sheath 12.

The wellbore 10 also includes a string of production casing 30. The production casing 30 is also secured in the wellbore 10 with a surrounding cement sheath 14. The production casing 30 has an upper end 32 in sealed connection with an upper master fracture valve 35. The production casing 30 also has a lower end (not shown). It is understood that the depth of the wellbore 10 preferably extends some distance below a lowest zone or subsurface interval to be stimulated to accommodate the length of the downhole tool, such as a perforating gun assembly. The downhole tool is attached to the end of a wireline 85.

The surface equipment 50 also includes one or more blow-out preventers 60. The blow-out preventers 60 are typically remotely actuated in the event of operational upsets. The lubricator 52, the crane arm 54, the crane base 56, the blow-out preventers 60 (and their associated ancillary control and/or actuation components) are standard equipment components known to those skilled in the art of well completion.

As shown in FIG. 1, a wellhead 70 is provided above the earth surface 105. The wellhead 70 is used to selectively seal the wellbore 10. During completion, the wellhead 70 includes various spooling components, sometimes referred to as spool pieces. The wellhead 70 and its spool pieces are used for flow control and hydraulic isolation during rig-up operations, stimulation operations, and rig-down operations.

The spool pieces may include a crown valve 72. The crown valve 72 is used to isolate the wellbore 10 from the lubricator 52 or other components above the wellhead. The spool pieces also include the lower master fracture valve 25 and the upper master fracture valve 35, referenced above. These lower 25 and upper 35 master fracture valves provide valve systems for isolation of wellbore pressures above and below their respective locations. Depending on site-specific practices and stimulation job design, it is possible that one of these isolation-type valves may not be needed or used.

The wellhead 70 and its spool pieces may also include side outlet injection valves 74. The side outlet injection valves 74 provide a location for injection of stimulation fluids into the wellbore 10. The piping from surface pumps (not shown) and tanks (not shown) used for injection of the stimulation fluids are attached to the valves 74 using appropriate hoses, fittings and/or couplings. The stimulation fluids are then pumped into the production casing 30.

The wellhead 70 and its spool pieces may also include a wireline isolation tool 76. The wireline isolation tool 76 provides a means to protect the wireline 85 from direct flow of proppant-laden fluid injected into the side outlet injection valves 74. However, it is noted that the wireline 85 is generally not protected from the proppant-laden fluids below the wellhead 70. Because the proppant-laden fluid is highly abrasive, this creates a ceiling as to the pump rate for pumping the downhole tools into the wellbore 10.

It is understood that the various items of surface equipment 50 and components of the wellhead 70 are merely illustrative. A typical completion operation will include numerous valves, pipes, tanks, fittings, couplings, gauges, and other devices. Further, downhole equipment may be run into and out of the wellbore using an electric line, coiled tubing, or a tractor. Alternatively, a drilling rig or other platform may be employed, with jointed working tubes being used.

In any instance, there is a need for downhole tools that may be deployed within a wellbore without a lubricator and a crane arm. Further, a need exists for tools that may be deployed in a string of production casing or other tubular body such as a pipeline that are autonomous, that is, they are not mechanically controlled from the surface. Further, a need exists for methods for perforating and treating multiple intervals along a wellbore without being limited by pump rate or the need for an elongated lubricator.

SUMMARY

The assemblies and methods described herein have various benefits in the conducting of oil and gas exploration and production activities. First, a tool assembly is provided. The tool assembly is intended for use in performing a tubular operation. In one embodiment, the tool assembly comprises an autonomously actuatable tool. The actuatable tool may be, for example, a fracturing plug, a bridge plug, a cutting tool, a casing patch, a cement retainer, or a perforating gun.

It is preferred that at least portions of the tool assembly, such as one or more of the aforementioned tools, be fabricated from a friable material. The tool assembly self-destructs in response to a designated event. Thus, where the tool is a fracturing plug, the tool assembly may self-destruct within the wellbore at a designated time after being set. Where the tool is a perforating gun, the tool assembly may self-destruct as the gun is being fired upon reaching a selected level or depth.

The tool assembly also includes a location device. The location device may be a separate component from an on-board controller, or may be integrally included within an on-board controller, such that a reference herein to the location device may be considered also a reference to the controller, and vice-versa. The location device is designed to sense the location of the actuatable tool within a tubular body. The tubular body may be, for example, a wellbore constructed to produce hydrocarbon fluids, or a pipeline for transportation fluids.

The location device senses location within the tubular body based on a physical signature provided along the tubular body. In one arrangement, the location device is a casing collar locator, and the physical signature is formed by the spacing of collars along the tubular body. The collars are sensed by the collar locator. In another arrangement, the location device is a radio frequency antenna, and the physical signature is formed by the spacing of identification tags along the tubular body. The identification tags are sensed by the radio frequency antenna.

The tool assembly also comprises an on-board controller. The controller is designed to send an actuation signal to the actuatable tool when the location device has recognized a selected location of the tool. The location is again based on the physical signature along the wellbore. The actuatable tool, the location device, and the on-board controller are together dimensioned and arranged to be deployed in the tubular body as an autonomous unit.

In one embodiment, the location device comprises a pair of sensing devices spaced apart along the tool assembly. The pair of sensing devices represents a lower sensing device and an upper sensing device. In this embodiment, the signature is formed by the placement of tags spaced along the tubular body, with the tags being sensed by each of the sensing devices.

The controller may comprise a clock that determines time that elapses between sensing by the lower sensing device and sensing by the upper sensing device as the tool assembly traverses across a tag. The tool assembly is programmed to determine tool assembly velocity at a given time based on the distance between the lower and upper sensing devices, divided by the elapsed time between sensing. The position of the tool assembly at the selected location along the tubular body may then be confirmed by a combination of (i) location of the tool assembly relative to the tags as sensed by either the lower or the upper sensing device, and (ii) velocity of the tool assembly as computed by the controller as a function of time.

Where the tool is a fracturing plug or a bridge plug, the plug may have an elastomeric sealing element. When the tool is actuated, the sealing element, which is generally in the configuration of a ring, is expanded to form a substantial fluid seal within the tubular body at a selected location. The plug may also have a set of slips for holding the location of the tool assembly proximate the selected location.

The assembly may include a fishing neck. This allows the operator to retrieve the tool in the event it becomes stuck or fails to fire.

Where the tool is a perforating gun assembly, it is preferred that the perforating gun assembly include a safety system for preventing premature detonation of the associated charges of the perforating gun.

In one arrangement of the assembly, the tool is a pig, while the tubular body is a pipeline carrying fluids. The pig is actuated at a certain location in the pipeline to perform a certain operation, such as collect a fluid sample or wipe a section of pipeline wall.

A method of perforating a wellbore at multiple zones of interest is also provided herein. In one embodiment, the method first includes providing a first autonomous perforating gun assembly. The first perforating gun assembly is substantially fabricated from a friable material, and is configured to detect a first selected zone of interest along the wellbore.

The method also includes deploying the first perforating gun assembly into the wellbore. Upon detecting that the first perforating gun assembly has reached the first selected zone of interest, the perforating gun assembly will fire shots along the first zone of interest to produce perforations.

The method further includes providing a second perforating gun assembly. The second perforating gun assembly is also substantially fabricated from a friable material, and is configured to detect a second selected zone of interest along the wellbore.

The method also includes deploying the second perforating gun assembly into the wellbore. Upon detecting that the second perforating gun assembly has reached the second selected zone of interest, the perforating gun assembly will fire shots along the second zone of interest to produce perforations.

The steps of deploying the perforating gun assemblies may be performed in different manners. These include pumping, using gravitational pull, using a tractor, or combinations thereof. Further, the perforating gun assemblies may optionally be dropped in any order for perforating different zones, depending on the wellbore completion protocol.

The method may also include releasing ball sealers from the second perforating gun assembly. This takes place before the perforating gun of the second perforating gun assembly is fired, or simultaneously therewith. The method then includes causing the ball sealers to temporarily seal perforations along the first zone of interest. In this embodiment, the second perforating gun assembly comprises a plurality of non-friable ball sealers, and a container disposed along the perforating gun assembly for temporarily holding the ball sealers. The ball sealers are released in response to a command from the on-board controller before the perforating gun of the second perforating gun assembly is fired, or simultaneously therewith.

The method of perforating a wellbore may further comprise providing an autonomous fracturing plug assembly. The fracturing plug assembly may be arranged as described above. For example, the fracturing plug assembly includes a fracturing plug having an elastomeric element for creating a fluid seal upon being actuated. The fracturing plug assembly is also configured to detect a selected location along the wellbore for setting. The method will then also include deploying the fracturing plug assembly into the wellbore. Upon detecting that the fracturing plug assembly has reached the selected location along the wellbore, the slips and the sealing element are together actuated to set the fracturing plug assembly.

A separate method for performing a wellbore completion operation is also provided. Preferably, the wellbore is constructed to produce hydrocarbon fluids from a subsurface formation or to inject fluids into a subsurface formation. In one aspect, the method first comprises running a tool assembly into the wellbore. Here, the tool assembly is run into the wellbore on a working line. The working may be a slickline, a wireline, or an electric line.

The tool assembly has an actuatable tool. The actuatable tool may be, for example, a fracturing plug, a cement retainer, or a bridge plug. The tool assembly also has a setting tool for setting the tool assembly.

The tool assembly also has a detonation device. Still further, the tool assembly includes an on-board processor. The on-board processor has a timer for self-destructing the tool assembly using the detonation device at a predetermined period of time after the tool is actuated in the wellbore. The tool assembly is fabricated from a friable material to aid in self-destruction.

The method also includes removing the working line after the tool assembly is set in the wellbore.

In one embodiment, the working line is a slickline, and the tool assembly further comprises a location device for sensing the location of the actuatable tool within the wellbore based on a physical signature provided along the wellbore. In this embodiment, the onboard processor is configured to send an actuation signal to the tool when the location device has recognized a selected location of the tool based on the physical signature. The actuatable tool is designed to be actuated to perform the wellbore operation in response to the actuation signal.

In another embodiment, the tool assembly further comprises a set of slips for holding the tool assembly in the wellbore. In this embodiment, the actuation signal actuates the slips to cause the tool assembly to be set in the wellbore at the selected location. Further, the on-board processor sends a signal to the detonation device a predetermined period of time after the tool assembly is set in the wellbore to self-destruct the tool assembly. The actuatable tool may be a bridge plug or a fracturing plug.

In yet another embodiment, the actuatable tool is a perforating gun. In this embodiment, the actuation signal actuates the perforating gun to create perforations along the wellbore at the selected location.

In still another embodiment, the claimed subject matter includes a tool assembly for performing a tubular operation, comprising: an actuatable tool comprising; (i) a location device for sensing the location of the actuatable tool within a tubular body based on a physical signature provided to the device along the tubular body; and (ii) a controller configured to send an actuation signal to the actuatable tool in response to the physical signature when the location device recognizes a selected actuation location for the tool; wherein: the actuatable tool, the location device, and the on-board controller are deployed in the tubular body as an autonomously actuatable unit; and the actuatable tool is autonomously actuatable to perform the tubular operation in response to receipt of an actuation signal from the controller, while the actuatable tool passes the actuation location along the tubular body.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 7A, an autonomous tool representing a combined plug assembly and perforating gun assembly is falling down the wellbore.

In FIG. 7B, the plug body of the plug assembly has been actuated, causing the autonomous tool to be seated in the wellbore at a selected depth. The perforating gun assembly is ready to fire.

In FIG. 8A, the fracturing plug assembly is in its run-in or pre-actuated position.

In FIG. 8B, the fracturing plug assembly is in its actuated state.

DETAILED DESCRIPTION

Definitions

Figure 1:
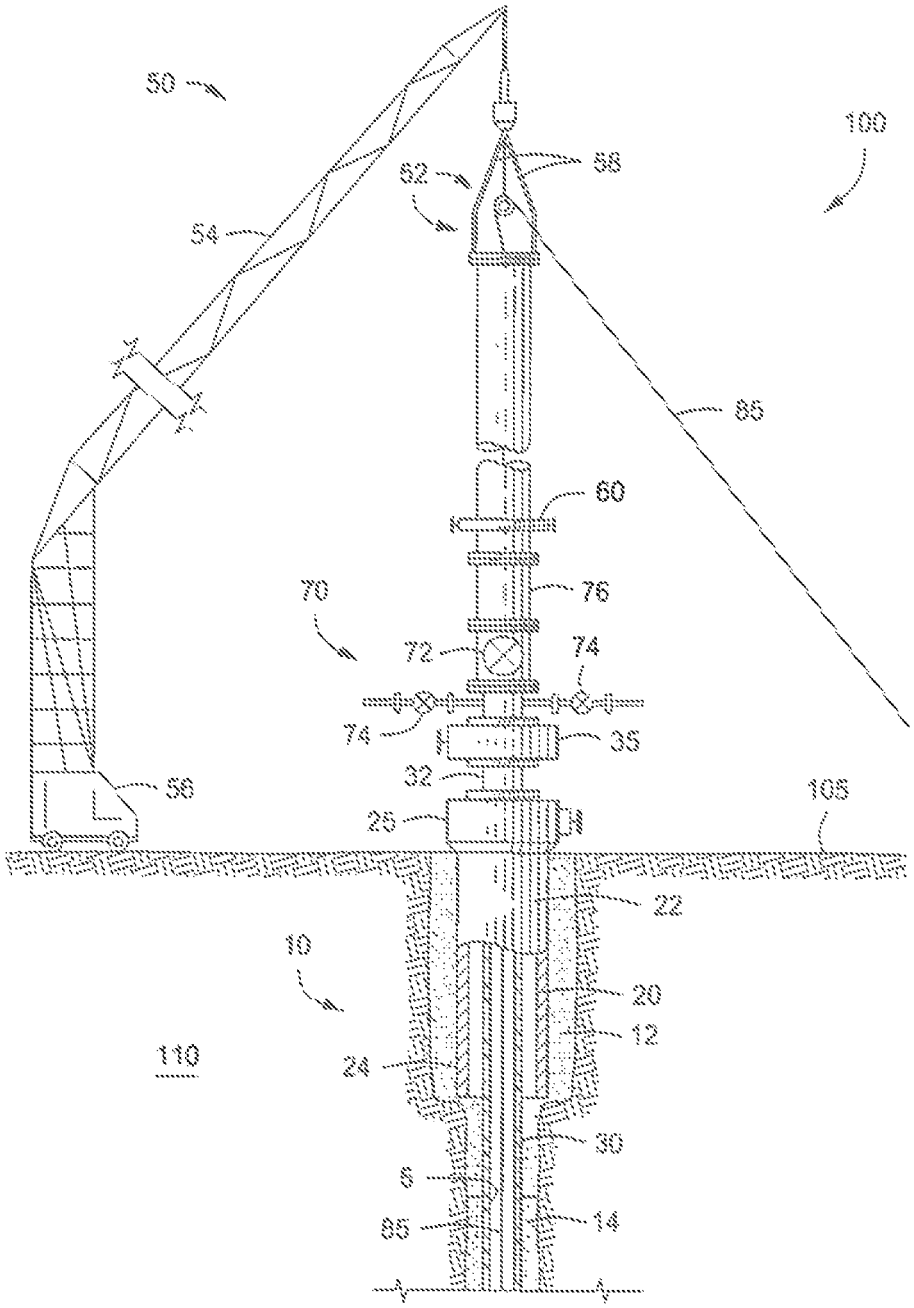
FIG. 1 (PRIOR ART)
FIG. 1 presents a presents a side view of a well site wherein a well is being completed. Known surface equipment is provided to support wellbore tools (not shown) above and within a wellbore. This is a depiction of the prior art.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refers to a portion of a formation containing hydrocarbons. Alternatively, the formation may be a water-bearing interval.

For purposes of the present disclosure, the terms "ceramic" or "ceramic material" may include oxides such as alumina and zirconia. Specific examples include bismuth strontium calcium copper oxide, silicon aluminum oxynitrides, uranium oxide, yttrium barium copper oxide, zinc oxide, and zirconium dioxide. "Ceramic" may also include non-oxides such as carbides, borides, nitrides and silicides. Specific examples include titanium carbide, silicon carbide, boron nitride, magnesium diboride, and silicon nitride. The term "ceramic" also includes composites, meaning particulate reinforced combinations of oxides and non-oxides. Additional specific examples of ceramics include barium titanate, strontium titanate, ferrite, and lead zierconate titanate.

For purposes of the present patent, the term "production casing" includes a liner string or any other tubular body fixed in a wellbore along a zone of interest.

The term "friable" means any material that may be crumbled, powderized, fractured, shattered, or broken into pieces, often preferably small pieces. The term "friable" also includes frangible materials such as ceramic. It is understood, however, that in many of the apparatus and method embodiments disclosed herein, components described as friable, may alternatively be comprised of drillable or millable materials, such that the components are destructible and/or otherwise removable from within the wellbore.

The terms "millable" is somewhat synonymous with the term "drillable," and both refer to any material that with the proper tools may be drilled, cut, or ground into pieces within a wellbore. Such materials may include, for example, aluminum, brass, cast iron, steel, ceramic, phenolic, composite, and combinations thereof. The terms may be used substantially interchangeably, although milling is more commonly used to refer to the process for removing a component from within a wellbore while drilling more commonly refers to producing the wellbore itself.

As used herein, the term "wellbore" refers to a hole in the subsurface made by drilling or insertion of a conduit into the subsurface. A wellbore may have a substantially circular cross section, or other cross-sectional shapes. As used herein, the term "well", when referring to an opening in the formation, may be used interchangeably with the term "wellbore."

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

The claimed subject matter discloses a seamless process for perforating and stimulating subsurface formations at sequential intervals before production casing has been installed. This technology, for purposes herein, may be referred to as the Just-In-Time-Perforating™ ("JITP") process. The JITP process allows an operator to fracture a well at multiple intervals with limited or even no "trips" out of the wellbore. The process has particular benefit for multi-zone fracture stimulation of tight gas reservoirs having numerous lenticular sand pay zones. For example, the JITP process is currently being used to recover hydrocarbon fluids in the Piceance basin.

The JITP technology is also the subject of U.S. Pat. No. 6,543,538, entitled "Method for Treating Multiple Wellbore Intervals." The '538 patent issued Apr. 8, 2003, and is incorporated by reference herein in its entirety. In one embodiment, the '538 patent generally teaches:

- using a perforating device, perforating at least one interval of one or more subterranean formations traversed by a wellbore;
- pumping treatment fluid through the perforations and into the selected interval without removing the perforating device from the wellbore;
- deploying or activating an item or substance in the wellbore to removably block further fluid flow into the treated perforations; and
- repeating the process for at least one more interval of the subterranean formation.

U.S. Pat. No. 6,394,184 covers an apparatus and method for perforating and treating multiple zones of one or more subterranean formations. In one aspect, the apparatus of the '184 patent comprises a bottom-hole assembly containing a perforating tool and a re-settable packer. The method includes, but is not limited to, pumping a treating fluid down the annulus created between the coiled tubing and the production casing. The re-settable packer is used to provide isolation between zones, while the perforating tool is used to perforate the multiple zones in a single rig-up and wellbore entry operation. This process, for purposes herein, may be referred to as the "Annular Coiled Tubing FRACturing (ACT-Frac). The ACT-Frac process allows the operator to more effectively stimulate multi-layer hydrocarbon formations at substantially reduced cost compared to previous completion methods.

The Just-in-Time Perforating ("JITP") and the Annular-Coiled Tubing Fracturing ("ACT-Frac") technologies, methods, and devices provide stimulation treatments to multiple subsurface formation targets within a single wellbore. In particular, the JITP and the ACT-Frac techniques: (1) enable stimulation of multiple target zones or regions via a single deployment of downhole equipment; (2) enable selective placement of each stimulation treatment for each individual zone to enhance well productivity; (3) provide diversion between zones to ensure each zone is treated per design and previously treated zones are not inadvertently damaged; and (4) allow for stimulation treatments to be pumped at high flow rates to facilitate efficient and effective stimulation. As a result, these multi-zone stimulation techniques enhance hydrocarbon recovery from subsurface formations that contain multiple stacked subsurface intervals.

While these multi-zone stimulation techniques provide for a more efficient completion process, they nevertheless typically involve the use of long, wireline-conveyed perforating guns. The use of such perforating guns presents various challenges, most notably, difficulty in running a long assembly of perforating guns through a lubricator and into the wellbore. In addition, pump rates are limited by the presence of the wireline in the wellbore during hydraulic fracturing due to friction or drag created on the wire from the abrasive hydraulic fluid. Further, cranes and wireline equipment present on location occupy needed space and create added completion expenses, thereby lowering the overall economics of a well-drilling project.

It is proposed herein to use tool assemblies for well-completion or other tubular operations that are autonomous. In this respect, the tool assemblies do not require a wireline and are not otherwise mechanically tethered to equipment external to the wellbore. The delivery method of a tool assembly may include gravity, pumping, and tractor delivery.

Various tool assemblies are therefore proposed herein that generally include:

- an actuatable tool;
- a location device for sensing the location of the actuatable tool within a tubular body based on a physical signature provided along the tubular body; and
- an on-board controller configured to send an actuation signal to the tool when the location device has recognized a selected location of the tool based on the physical signature.

The actuatable tool is designed to be actuated to perform a tubular operation in response to the actuation signal.

The actuatable tool, the location device, and the on-board controller are together dimensioned and arranged to be deployed in the tubular body as an autonomously actuatable unit. The tubular body may be a wellbore constructed to produce hydrocarbon fluids. Alternatively, the tubular body may be a pipeline transporting fluids.

Figure 2:
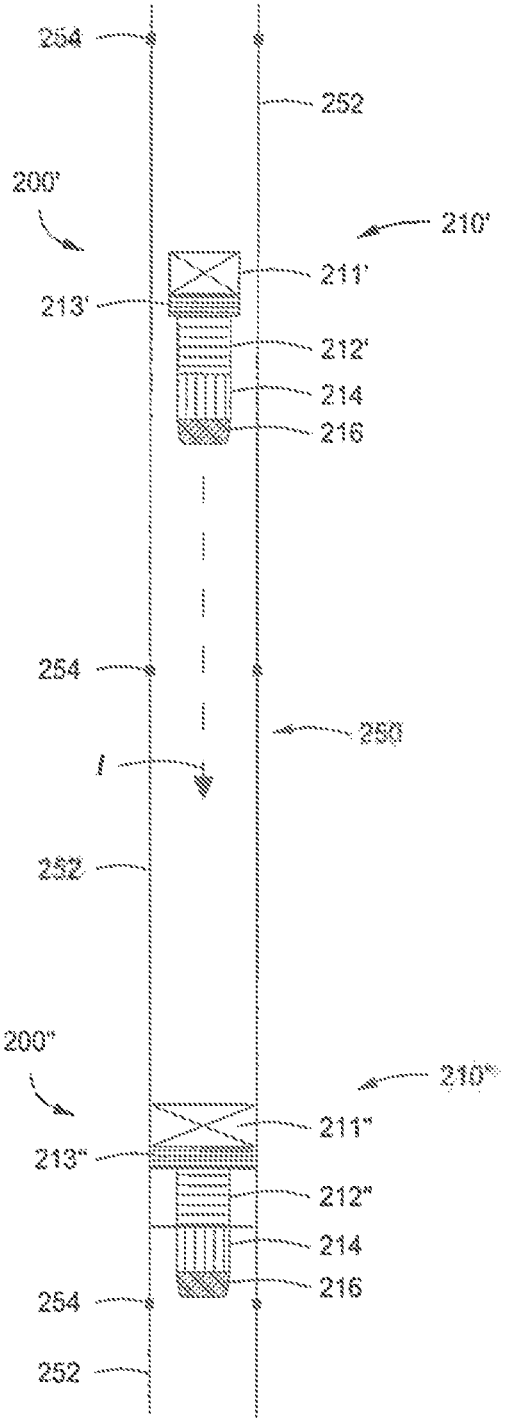
FIG. 2 is a side view of an autonomous tool as may be used for tubular operations, such as operations in a wellbore, without need of the lubricator of FIG. 1. In this view, the tool is a fracturing plug assembly deployed in a string of production casing. The fracturing plug assembly is shown in both a pre-actuated position and an actuated position.

FIG. 2 presents a side view of an illustrative autonomous tool 200' as may be used for tubular operations. In this view, the tool 200' is a fracturing plug assembly, and the tubular operation is a wellbore completion.

The fracturing plug assembly 200' is deployed within a string of production casing 250. The production casing 250 is formed from a plurality of "joints" 252 that are threadedly connected at collars 254. The wellbore completion includes the injection of fluids into the production casing 250 under high pressure.

In FIG. 2, the fracturing plug assembly is shown in both a pre-actuated position and an actuated position. The fracturing plug assembly is shown in a pre-actuated position at 200', and in an actuated position at 200". Arrow "I" indicates the movement of the fracturing plug assembly 200' in its pre-actuated position, down to a location in the production casing 250 where the fracturing plug assembly 200" is in its actuated position. The fracturing plug assembly will be described primarily with reference to its pre-actuated position, at 200'.

The fracturing plug assembly 200' first includes a plug body 210'. The plug body 210' will preferably define an elastomeric sealing element 211' and a set of slips 213'. The elastomeric sealing element 211' is mechanically expanded in response to a shift in a sleeve or other means as is known in the art. The slips 213' also ride outwardly from the assembly 200' along wedges (not shown) spaced radially around the assembly 200'. Preferably, the slips 213' are also urged outwardly along the wedges in response to a shift in the same sleeve or other means as is known in the art. The slips 213' extend radially to "bite" into the casing when actuated, securing the plug assembly 200' in position. Examples of existing plugs with suitable designs are the Smith Copperhead Drillable Bridge Plug and the Halliburton Fas Drill® Frac Plug.

The fracturing plug assembly 200' also includes a setting tool 212'. The setting tool 212' will actuate the slips 213' and the elastomeric sealing element 211' and translate them along the wedges to contact the surrounding casing 250.

In the actuated position for the plug assembly 200", the plug body 210" is shown in an expanded state. In this respect, the elastomeric sealing element 211" is expanded into sealed engagement with the surrounding production casing 250, and the slips 213" are expanded into mechanical engagement with the surrounding production casing 250. The sealing element 211" comprises a sealing ring, while the slips 213" offer grooves or teeth that "bite" into the inner diameter of the casing 250. Thus, in the tool assembly 200", the plug body 210" consisting of the sealing element 211" and the slips 213" defines the actuatable tool.

The fracturing plug assembly 200' also includes a position locator 214. The position locator 214 serves as a location device for sensing the location of the tool assembly 200' within the production casing 250. More specifically, the position locator 214 senses the presence of objects or "tags" along the wellbore 250, and generates depth signals in response.

In the view of FIG. 2, the objects are the casing collars 254. This means that the position locator 214 is a casing collar locator, known in the industry as a "CCL." The CCL senses the location of the casing collars 254 as it moves down the production casing 250. While FIG. 2 presents the position locator 214 as a CCL and the objects as casing collars, it is understood that other sensing arrangements may be employed in the fracturing plug assembly 200'. For example, the position locator 214 may be a radio frequency detector, and the objects may be radio frequency identification tags, or "RFID" devices. In this arrangement, the tags may be placed along the inner diameters of selected casing joints 252, and the position locator 214 will define an RFID antenna/reader that detects the RFID tags. Alternatively, the position locator 214 may be both a casing collar locator and a radio frequency antenna. The radio frequency tags may be placed, for example, every 500 feet or every 1,000 feet to assist a casing collar locator algorithm.

The fracturing plug assembly 200' further includes an on-board controller 216. The on-board controller 216 processes the depth signals generated by the position locator 214. In one aspect, the on-board controller 216 compares the generated signals with a pre-determined physical signature obtained for wellbore objects. For example, a CCL log may be run before deploying the autonomous tool (such as the fracturing plug assembly 200') in order to determine the spacing of the casing collars 254. The corresponding depths of the casing collars 254 may be determined based on the length and speed of the wireline pulling a CCL logging device.

In another aspect, the operator may have access to a wellbore diagram providing exact information concerning the spacing of tags such as the casing collars 254. The on-board controller 216 may then be programmed to count the casing collars 254, thereby determining the location of the fracturing plug assembly 200' as it is urged downwardly in the wellbore. In some instances, the production casing 250 may be pre-designed to have so-called short joints, that is, selected joints that are only, for example, 15 feet, or 20 feet, in length, as opposed to the "standard" length selected by the operator for completing a well, such as 30 feet. In this event, the on-board controller 216 may use the non-uniform spacing provided by the short joints as a means of checking or confirming a location in the wellbore as the fracturing plug assembly 200' moves through the production casing 250.

In yet another arrangement, the position locator 214 comprises an accelerometer. An accelerometer is a device that measures acceleration experienced during a freefall. An accelerometer may include multi-axis capability to detect magnitude and direction of the acceleration as a vector quantity. When in communication with analytical software, the accelerometer allows the position of an object to be determined. Preferably, the position locator would also include a gyroscope. The gyroscope would maintain the orientation of the fracturing plug assembly 200'.

In any event, the on-board controller 216 further activates the actuatable tool when it determines that the autonomous tool has arrived at a particular depth adjacent a selected zone of interest. In the example of FIG. 2, the on-board controller 216 activates the fracturing plug 210" and the setting tool 212" to cause the fracturing plug assembly 200" to stop moving, and to set in the production casing 250 at a desired depth or location.

In one aspect, the on-board controller 216 includes a timer. The on-board controller 216 is programmed to release the fracturing plug 210" after a designated time. This may be done by causing the sleeve in the setting tool 212" to reverse itself. The fracturing plug assembly 200" may then be flowed back to the surface and retrieved via a pig catcher (not shown) or other such device. Alternatively, the on-board controller 216 may be programmed after a designated period of time to ignite a detonating device, which then causes the fracturing plug assembly 200" to detonate and self-destruct. The detonating device may be a detonating cord, such as the Primacord® detonating cord. In this arrangement, the entire fracturing plug assembly 200" is fabricated from a friable material such as ceramic.

Figure 3:
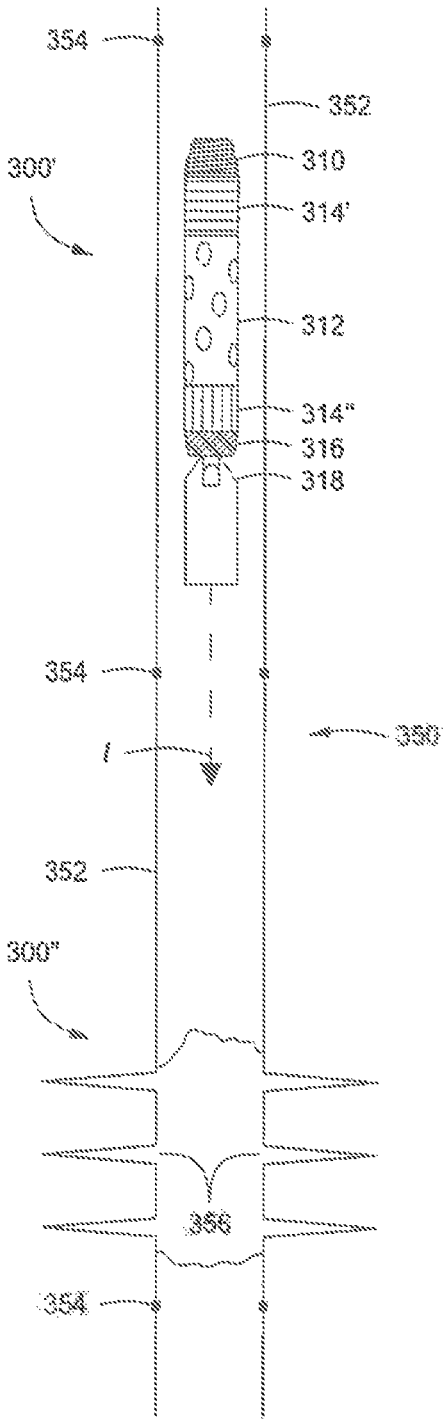
FIG. 3 is a side view of an autonomous tool as may be used for tubular operations, such as operations in a wellbore, in an alternate view. In this view, the tool is a perforating gun assembly. The perforating gun assembly is once again deployed in a string of production casing, and is shown in both a pre-actuated position and an actuated position.

Other arrangements for an autonomous tool besides the fracturing plug assembly 200'/200" may be used. FIG. 3 presents a side view of an alternative arrangement for an autonomous tool 300' as may be used for tubular operations. In this view, the tool 300' is a perforating gun assembly.

In FIG. 3, the perforating gun assembly is shown in both a pre-actuated position and an actuated position. The perforating gun assembly is shown in a pre-actuated position at 300', and is shown in an actuated position at 300". Arrow "I" indicates the movement of the perforating gun assembly 300' in its pre-actuated (or run-in) position, down to a location in the wellbore where the perforating gun assembly 300" is in its actuated position 300". The perforating gun assembly will be described primarily with reference to its pre-actuated position, at 300', as the actuated position 300" means complete destruction of the assembly 300'.

The perforating gun assembly 300' is again deployed within a string of production casing 350. The production casing 350 is formed from a plurality of "joints" 352 that are threadedly connected at collars 354. The wellbore completion includes the perforation of the production casing 350 at various selected intervals using the perforating gun assembly 300'. Utilization of the perforating gun assembly 300' is described more fully in connection with FIGS. 4A-4M and 5A-5I, below.

The perforating gun assembly 300' first optionally includes a fishing neck 310. The fishing neck 310 is dimensioned and configured to serve as the male portion to a mating downhole fishing tool (not shown). The fishing neck 310 allows the operator to retrieve the perforating gun assembly 300' in the unlikely event that it becomes stuck in the casing 352 or fails to detonate.

The perforating gun assembly 300' also includes a perforating gun 312. The perforating gun 312 may be a select fire gun that fires, for example, 16 shots. The gun 312 has an associated charge that detonates in order to cause shots to be fired from the gun 312 into the surrounding production casing 350. Typically, the perforating gun contains a string of shaped charges distributed along the length of the gun and oriented according to desired specifications. The charges are preferably connected to a single detonating cord to ensure simultaneous detonation of all charges. Examples of suitable perforating guns include the Frac Gun™ from Schlumberger, and the G-Force® from Halliburton.

The perforating gun assembly 300' also includes a position locator 314'. The position locator 314' operates in the same manner as the position locator 214 for the fracturing plug assembly 200'. In this respect, the position locator 314' serves as a location device for sensing the location of the perforating gun assembly 300' within the production casing 350. More specifically, the position locator 314' senses the presence of objects or "tags" along the wellbore 350, and generates depth signals in response.

In the view of FIG. 3, the objects are again the casing collars 354. This means that the position locator 314' is a casing collar locator, or "CCL." The CCL senses the location of the casing collars 354 as it moves down the wellbore. Of course, it is again understood that other sensing arrangements may be employed in the perforating gun assembly 300', such as the use of "RFID" devices.

The perforating gun assembly 300' further includes an on-board controller 316. The on-board controller 316 preferably operates in the same manner as the on-board controller 216 for the fracturing plug assembly 200'. In this respect, the on-board controller 316 processes the depth signals generated by the position locator 314' using appropriate logic and power units. In one aspect, the on-board controller 316 compares the generated signals with a predetermined physical signature obtained for the wellbore objects (such as collars 354). For example, a CCL log may be run before deploying the autonomous tool (such as the perforating gun assembly 300') in order to determine the spacing of the casing collars 354. The corresponding depths of the casing collars 354 may be determined based on the speed of the wireline that pulled the CCL logging device.

The on-board controller 316 activates the actuatable tool when it determines that the autonomous tool 300' has arrived at a particular depth adjacent a selected zone of interest. This is done using appropriate onboard processing. In the example of FIG. 3, the on-board controller 316 activates a detonating cord that ignites the charge associated with the perforating gun 310 to initiate the perforation of the production casing 250 at a desired depth or location. Illustrative perforations are shown in FIG. 3 at 356.

In addition, the on-board controller 316 generates a separate signal to ignite the detonating cord to cause complete destruction of the perforating gun assembly. This is shown at 300". To accomplish this, the components of the gun assembly 300' are fabricated from a friable material. The perforating gun 312 may be fabricated, for example, from ceramic materials. Upon detonation, the material making up the perforating gun assembly 300' may become part of the proppant mixture injected into fractures in a later completion stage.

In one aspect, the perforating gun assembly 300' also includes a ball sealer carrier 318. The ball sealer carrier 318 is preferably placed at the bottom of the assembly 300'. Destruction of the assembly 300' causes ball sealers (not shown) to be released from the ball sealer carrier 318. Alternatively, the on-board controller 316 may have a timer that releases the ball sealers from the ball sealer carrier 318 shortly before the perforating gun 312 is fired, or simultaneously therewith. As will be described more fully below, the ball sealers are used to seal perforations that have been formed at a lower depth or location in the wellbore.

It is desirable with the perforating gun assembly 300' to provide various safety features that prevent the premature firing of the perforating gun 312. These are in addition to the locator device 314' described above.

Figure 4A:
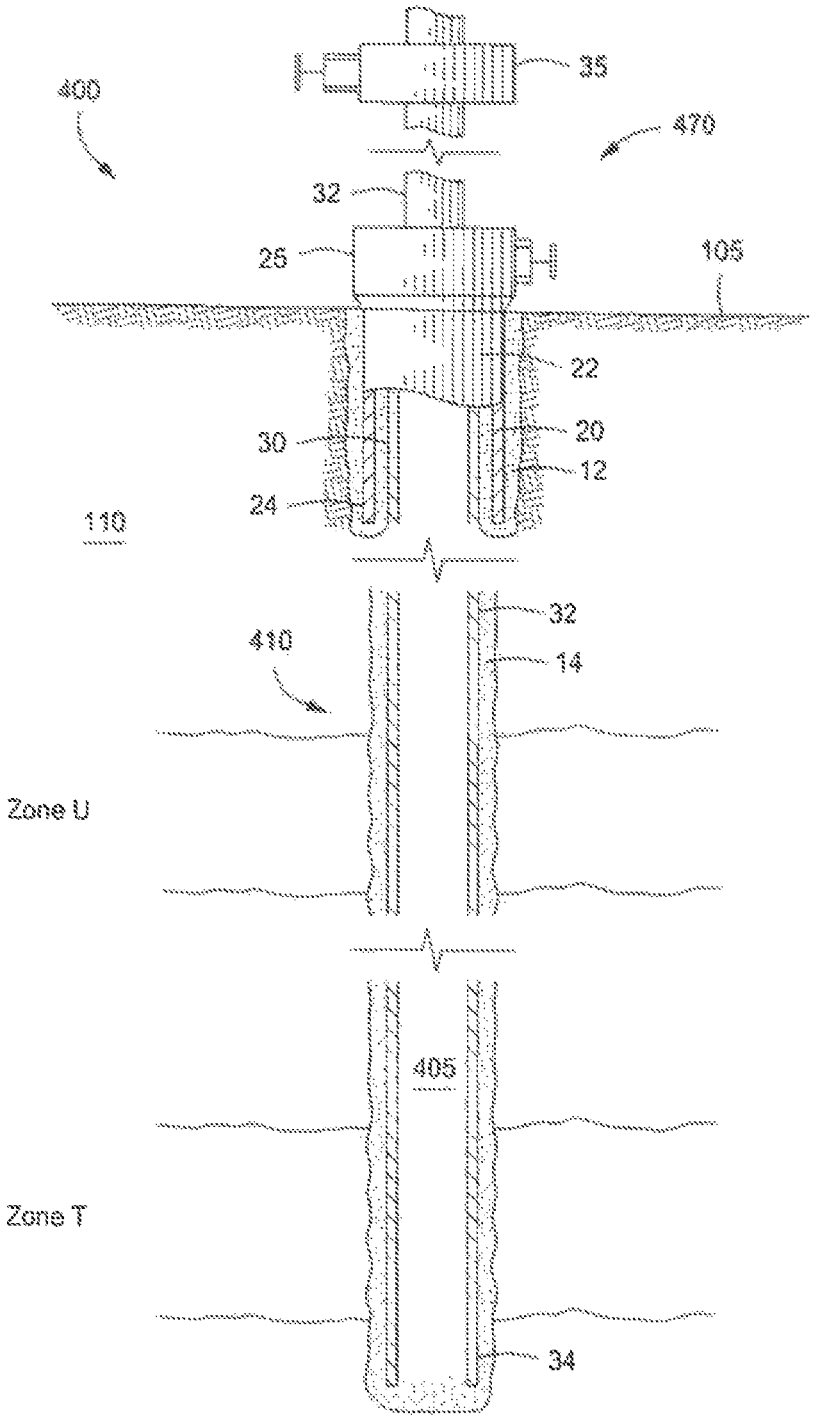
FIG. 4A is a side view of a well site having a wellbore for receiving an autonomous tool. The wellbore is being completed in at least zones of interest "T" and "U."

FIGS. 4A through 4M demonstrate the use of the fracturing plug assembly 200' and the perforating gun assembly 300' in an illustrative wellbore. First, FIG. 4A presents a side view of a well site 400. The well site 400 includes a wellhead 470 and a wellbore 410. The wellbore 410 includes a bore 405 for receiving the assemblies 200', 300'. The wellbore 410 is generally in accordance with wellbore 10 of FIG. 1; however, it is shown in FIG. 4A that the wellbore 410 is being completed in at least zones of interest "T" and "U" within a subsurface 110.

As with wellbore 10, the wellbore 410 is first formed with a string of surface casing 20. The surface casing 20 has an upper end 22 in sealed connection with a lower master fracture valve 25. The surface casing 20 also has a lower end 24. The surface casing 20 is secured in the wellbore 410 with a surrounding cement sheath 12.

The wellbore 410 also includes a string of production casing 30. The production casing 30 is also secured in the wellbore 410 with a surrounding cement sheath 14. The production casing 30 has an upper end 32 in sealed connection with an upper master fracture valve 35. The production casing 30 also has a lower end 34. The production casing 30 extends through a lowest zone of interest "T," and also through at least one zone of interest "U" above the zone "T." A wellbore operation will be conducted that includes perforating each of zones "T" and "U" sequentially.

A wellhead 470 is positioned above the wellbore 410. The wellhead 470 includes the lower 25 and upper 35 master fracture valves. The wellhead 470 will also include blow-out preventers (not shown), such as the blow-out preventer 60 shown in FIG. 1.

FIG. 4A differs from FIG. 1 in that the well site 400 will not have the lubricator or associated surface equipment components. In addition, no wireline is shown. Instead, the operator can simply drop the fracturing plug assembly 200' and the perforating gun assembly 300' into the wellbore 410. To accommodate this, the upper end 32 of the production casing 30 may extend a bit longer, for example, five to ten feet, between the lower 25 and upper 35 master fracture valves.

Figure 4B:
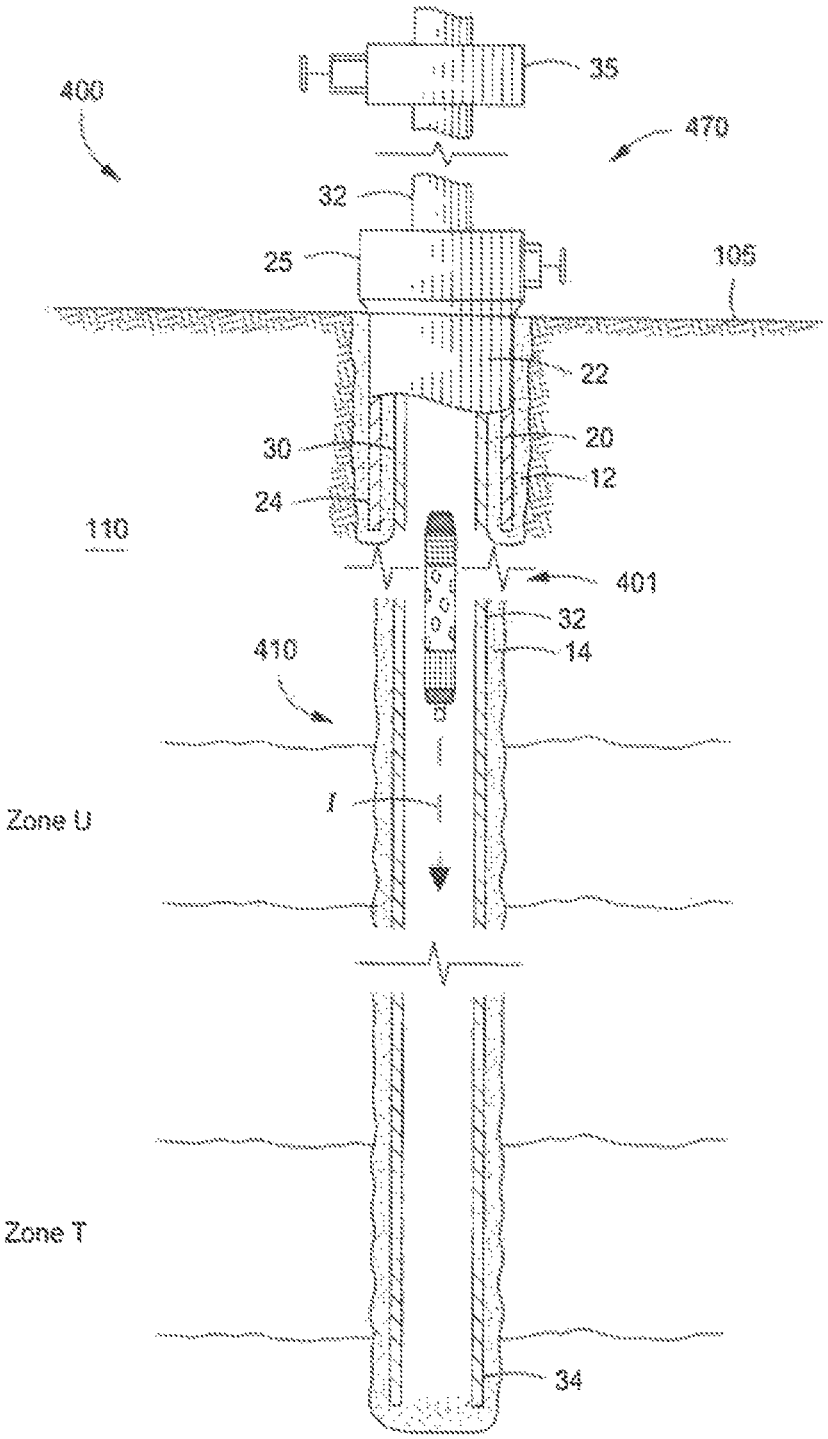
FIG. 4B is a side view of the well site of FIG. 4A. Here, the wellbore has received a first perforating gun assembly, in one embodiment.

FIG. 4B is a side view of the well site 400 of FIG. 4A. Here, the wellbore 410 has received a first perforating gun assembly 401. The first perforating gun assembly 401 is generally in accordance with the perforating gun assembly 300' of FIG. 3 in its various embodiments, as described above. It can be seen that the perforating gun assembly 401 is moving downwardly in the wellbore 410, as indicated by arrow "I." The perforating gun assembly 401 may be simply falling through the wellbore 410 in response to gravitational pull. In addition, the operator may be assisting the downward movement of the perforating gun assembly 401 by applying hydraulic pressure through the use of surface pumps (not shown). Alternatively, the perforating gun assembly 401 may be aided in its downward movement through the use of a tractor (not shown). In this instance, the tractor will be fabricated entirely of a friable material.

Figure 4C:
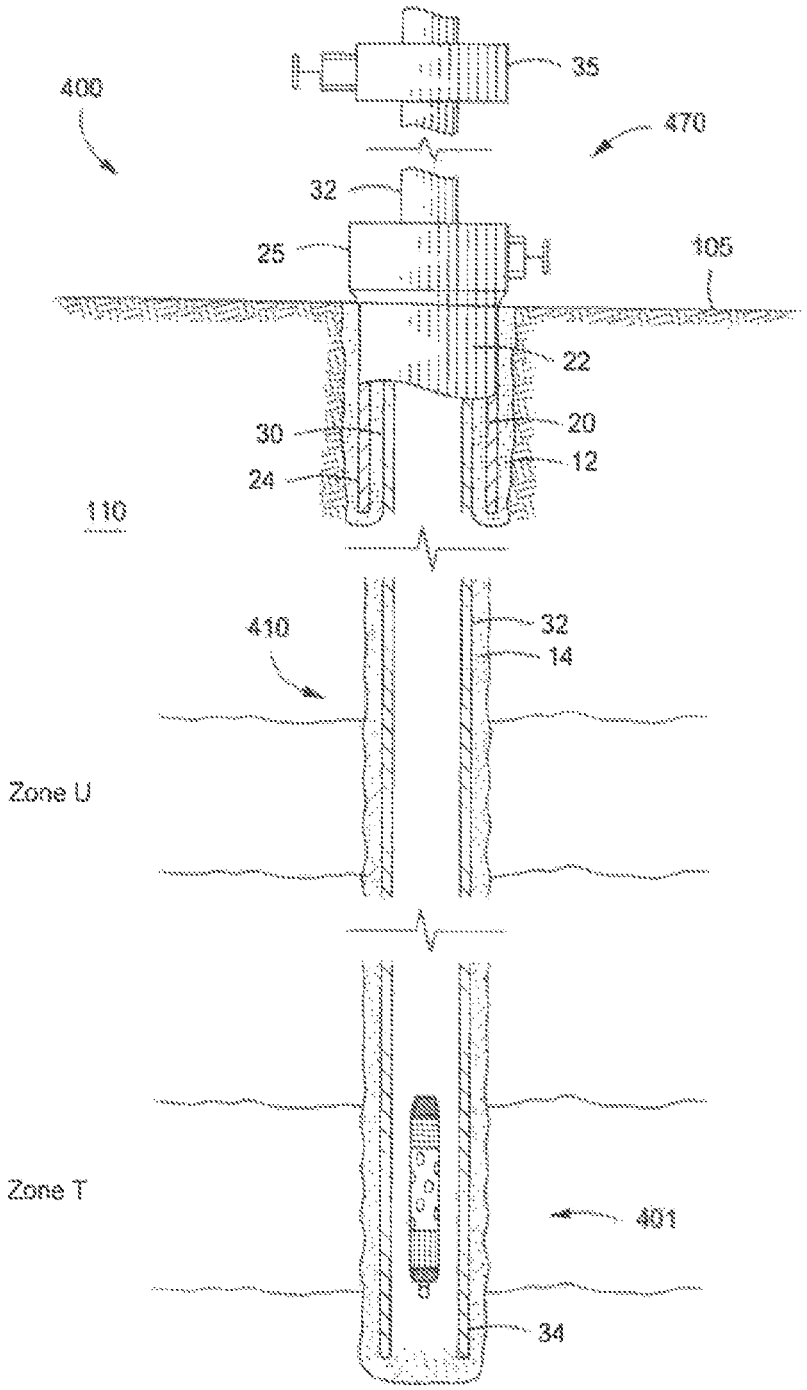
FIG. 4C is another side view of the well site of FIG. 4A. Here, the first perforating gun assembly has fallen in the wellbore to a position adjacent zone of interest "T."

FIG. 4C is another side view of the well site 400 of FIG. 4A. Here, the first perforating gun assembly 401 has fallen in the wellbore 410 to a position adjacent zone of interest "T." In accordance with the present inventions, the locator device (shown at 314' in FIG. 3) has generated signals in response to tags placed along the production casing 30. In this way, the on-board controller (shown at 316 of FIG. 3) is aware of the location of the first perforating gun assembly 401.

Figure 4D:
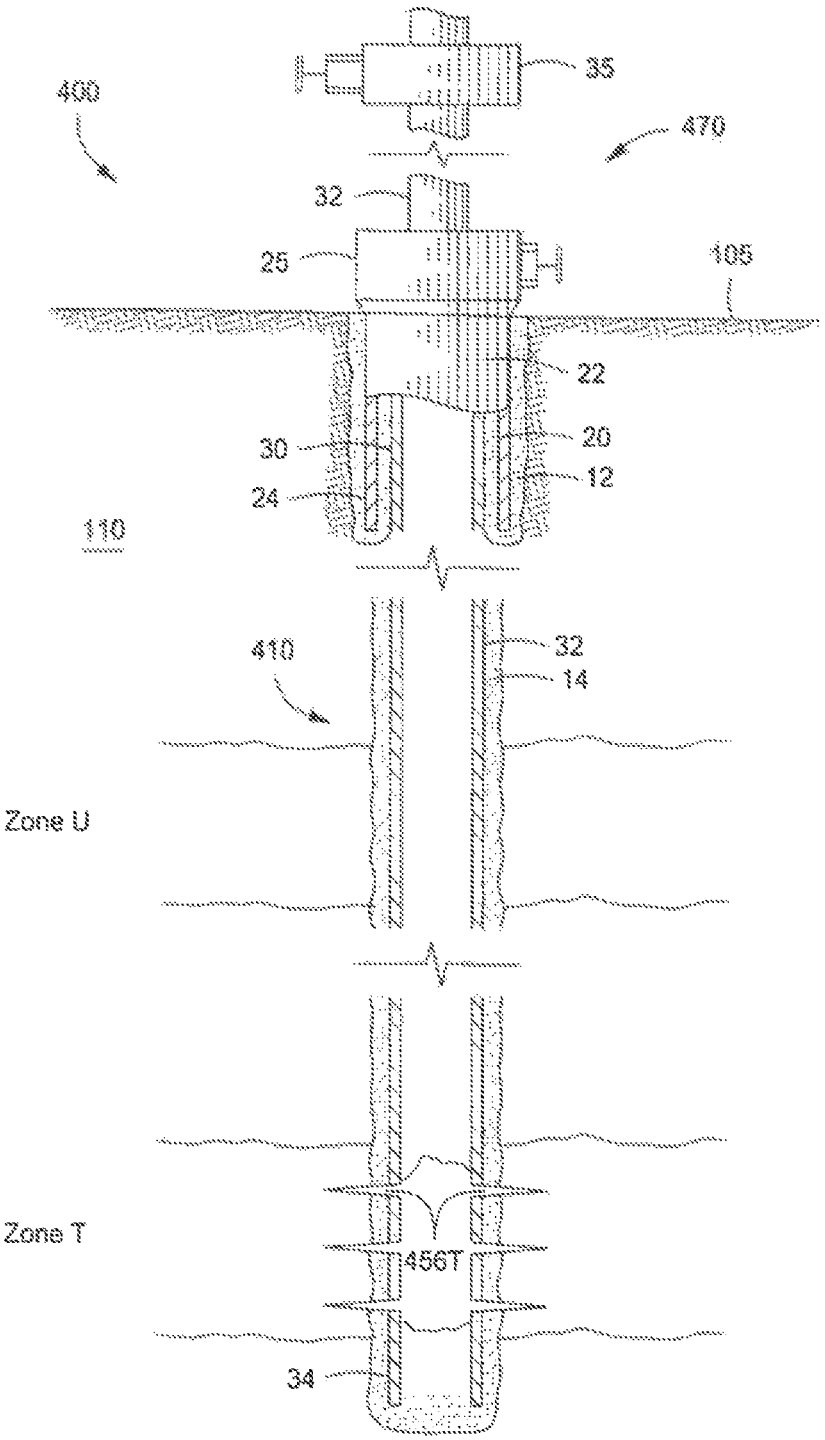
FIG. 4D is another side view of the well site of FIG. 4A. Here, charges of the first perforating gun assembly have been detonated, causing the perforating gun of the perforating gun assembly to fire. The casing along the zone of interest "T" has been perforated.

FIG. 4D is another side view of the well site 400 of FIG. 4A. Here, charges of the perforating gun assembly 401 have been detonated, causing the perforating gun (shown at 312 of FIG. 3) to fire. The casing along zone of interest "T" has been perforated. A set of perforations 456T is shown extending from the wellbore 410 and into the subsurface 110. While only six perforations 456T are shown in the side view, it us understood that additional perforations may be formed, and that such perforations will extend radially around the production casing 30.

In addition to the creation of perforations 456A, the perforating gun assembly 401 is self-destructed. Any pieces left from the assembly 401 will likely fall to the bottom 34 of the production casing 30.

Figure 4E:
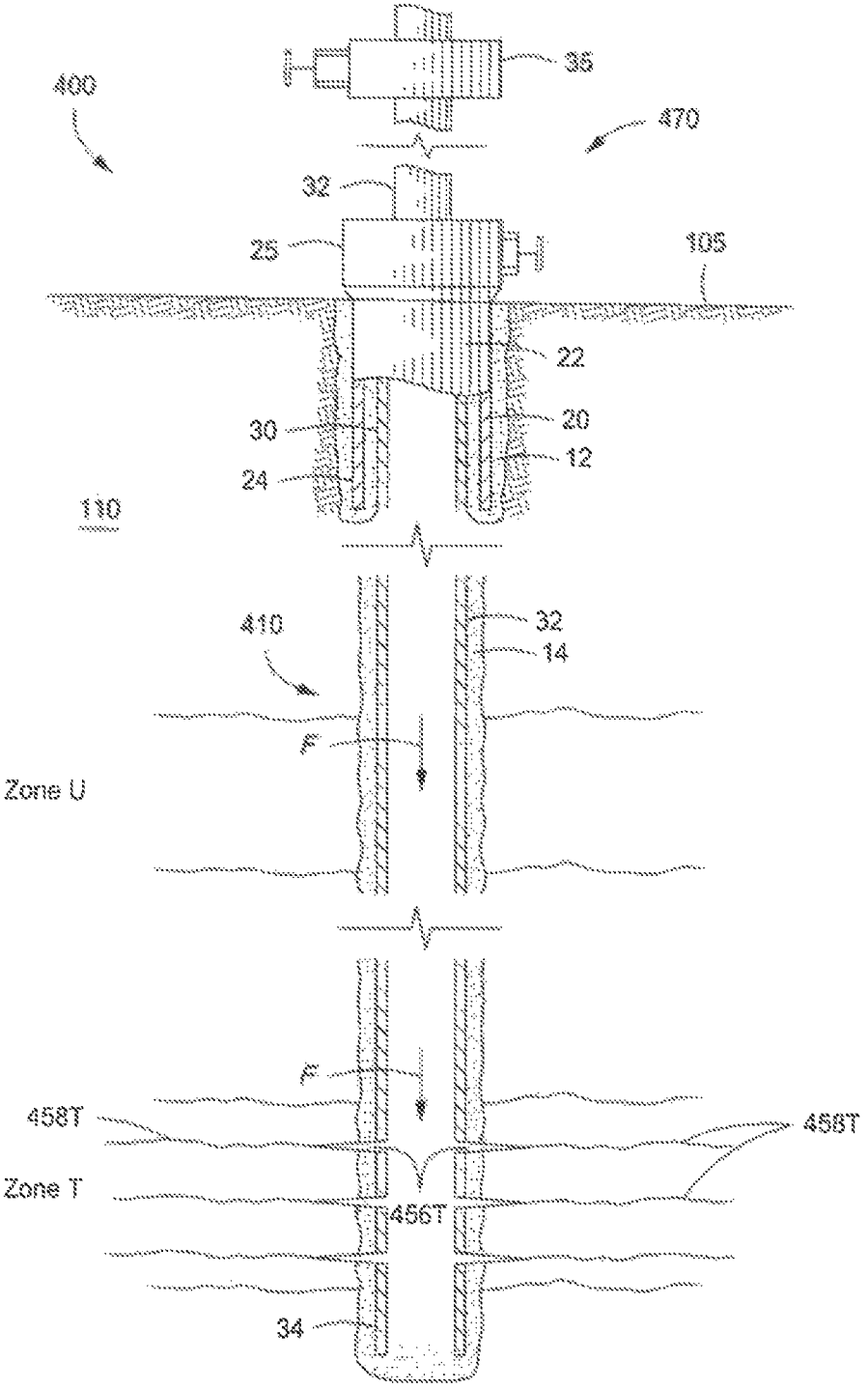
FIG. 4E is yet another side view of the well site of FIG. 4A. Here, fluid is being injected into the wellbore under high pressure, causing the formation within the zone of interest "T" to be fractured.

FIG. 4E is yet another side view of the well site 400 of FIG. 4A. Here, fluid is being injected into the bore 405 of the wellbore 410 under high pressure. Downward movement of the fluid is indicated by arrows "F." The fluid moves through the perforations 456T and into the surrounding subsurface 110. This causes fractures 458T to be formed within the zone of interest "T." An acid solution may also optionally be circulated into the bore 405 to remove carbonate build-up and remaining drilling mud and further stimulate the subsurface 110 for hydrocarbon production.

Figure 4F:
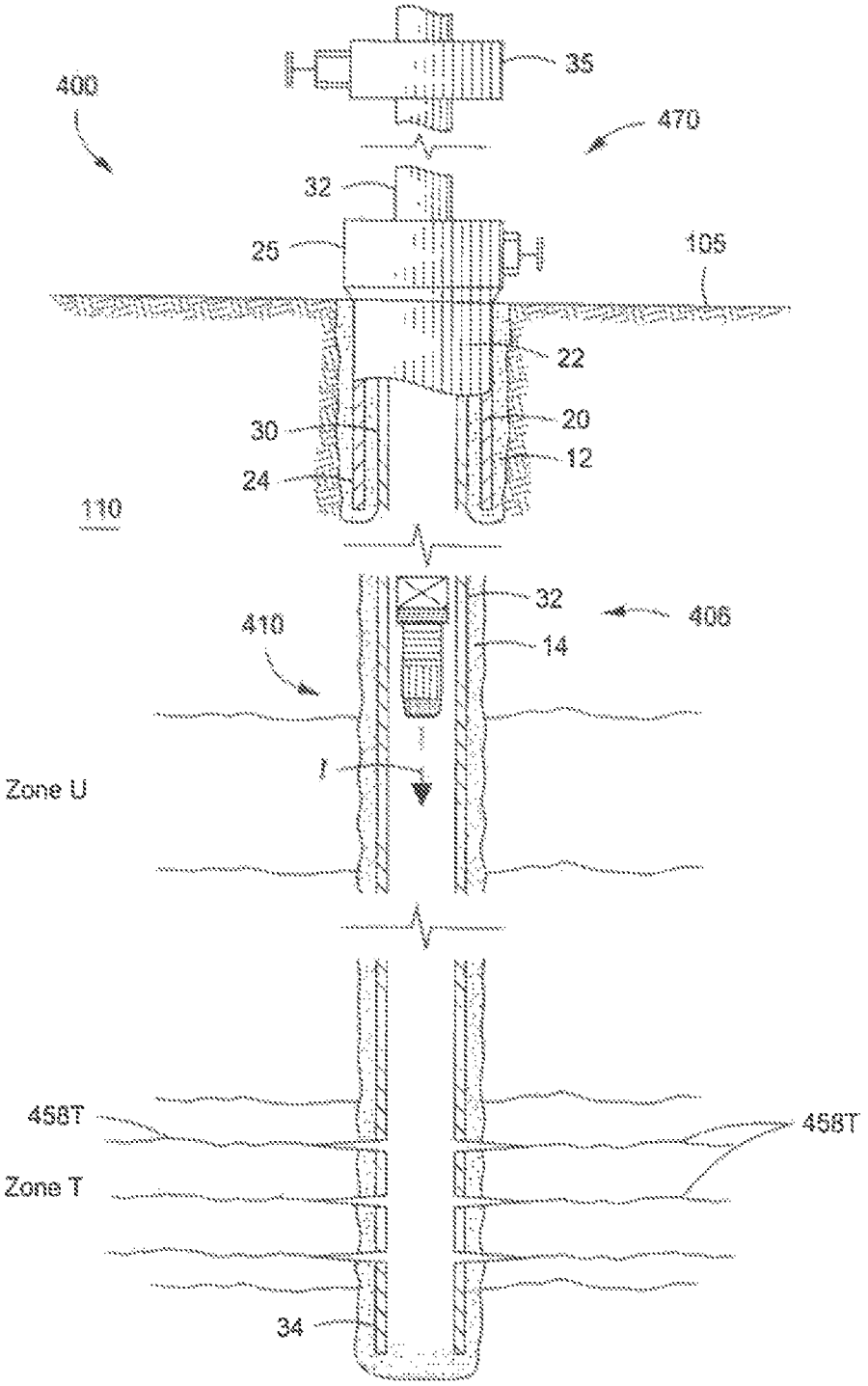
FIG. 4F is another side view of the well site of FIG. 4A. Here, the wellbore has received a fracturing plug assembly, in one embodiment.

FIG. 4F is yet another side view of the well site 400 of FIG. 4A. Here, the wellbore 410 has received a fracturing plug assembly 406. The fracturing plug assembly 406 is generally in accordance with the fracturing plug assembly 200' of FIG. 2 in its various embodiments, as described above.

In FIG. 4F, the fracturing plug assembly 406 is in its run-in (pre-actuated) position. The fracturing plug assembly 406 is moving downwardly in the wellbore 410, as indicated by arrow "I." The fracturing plug assembly 406 may simply be falling through the wellbore 410 in response to gravitational pull. In addition, the operator may be assisting the downward movement of the fracturing plug assembly 406 by applying pressure through the use of surface pumps (not shown).

Figure 4G:
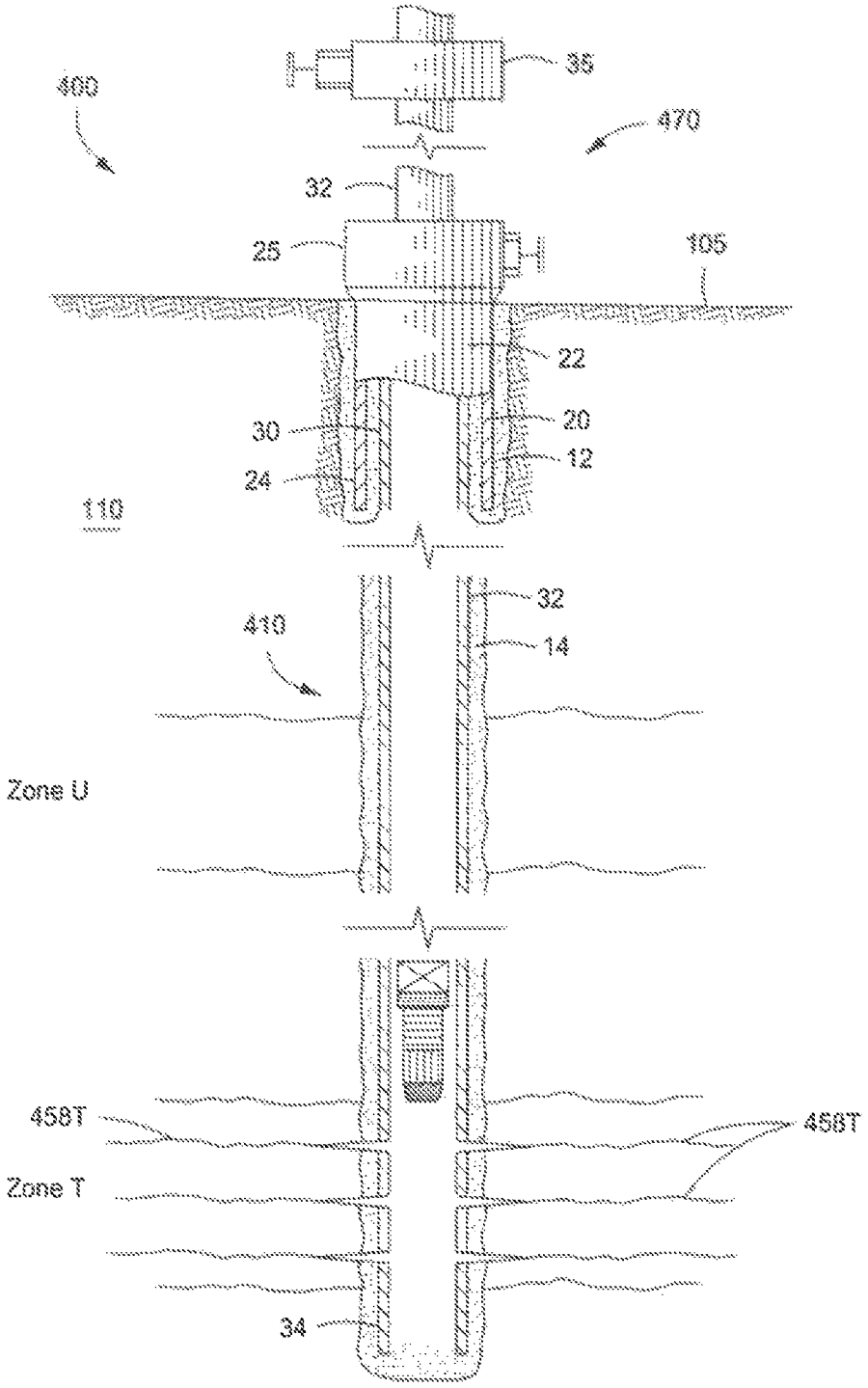
FIG. 4G is still another side view of the well site of FIG. 4A. Here, the fracturing plug assembly has fallen in the wellbore to a position above the zone of interest "T."

FIG. 4G is still another side view of the well site 400 of FIG. 4A. Here, the fracturing plug assembly 406 has fallen in the wellbore 410 to a position above the zone of interest "T." In accordance with the present inventions, the locator device (shown at 214 in FIG. 2) has generated signals in response to tags placed along the production casing 30. In this way, the on-board controller (shown at 216 of FIG. 2) is aware of the location of the fracturing plug assembly 406.

Figure 4H:
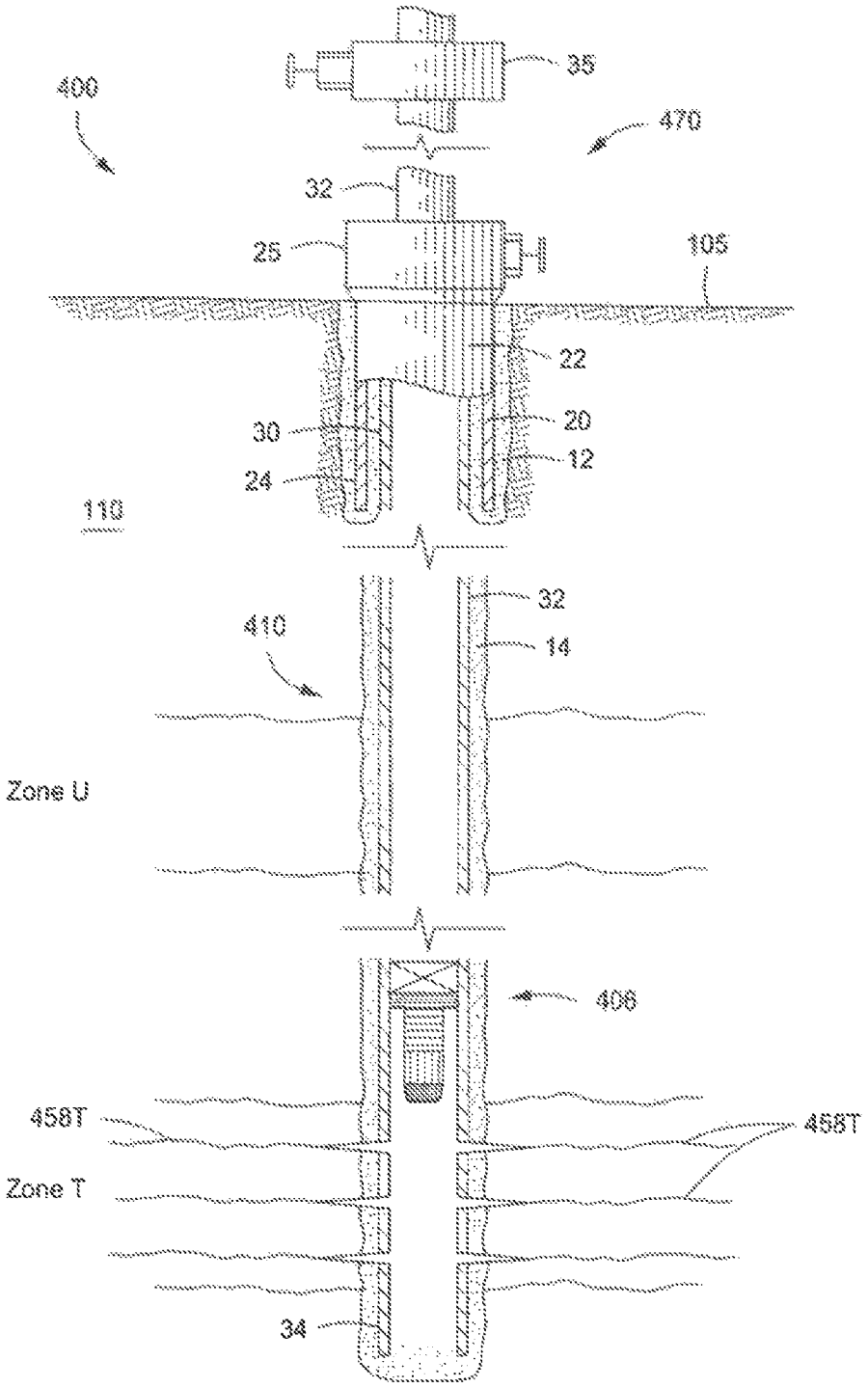
FIG. 4H is another side view of the well site of FIG. 4A. Here, the fracturing plug assembly has been actuated and set.

FIG. 4H is another side view of the well site 400 of FIG. 4A. Here, the fracturing plug assembly 406 has been set. This means that on-board controller has generated signals to activate the setting tool (shown at 212 of FIG. 2 and the plug (shown at 210' of FIG. 2) and the slips (shown at 213') to set and to seal the plug assembly 406 in the bore 405 of the wellbore 410. In FIG. 4H, the fracturing plug assembly 406 has been set above the zone of interest "T." This allows isolation of the zone of interest "U" for a next perforating stage.

Figure 4I:
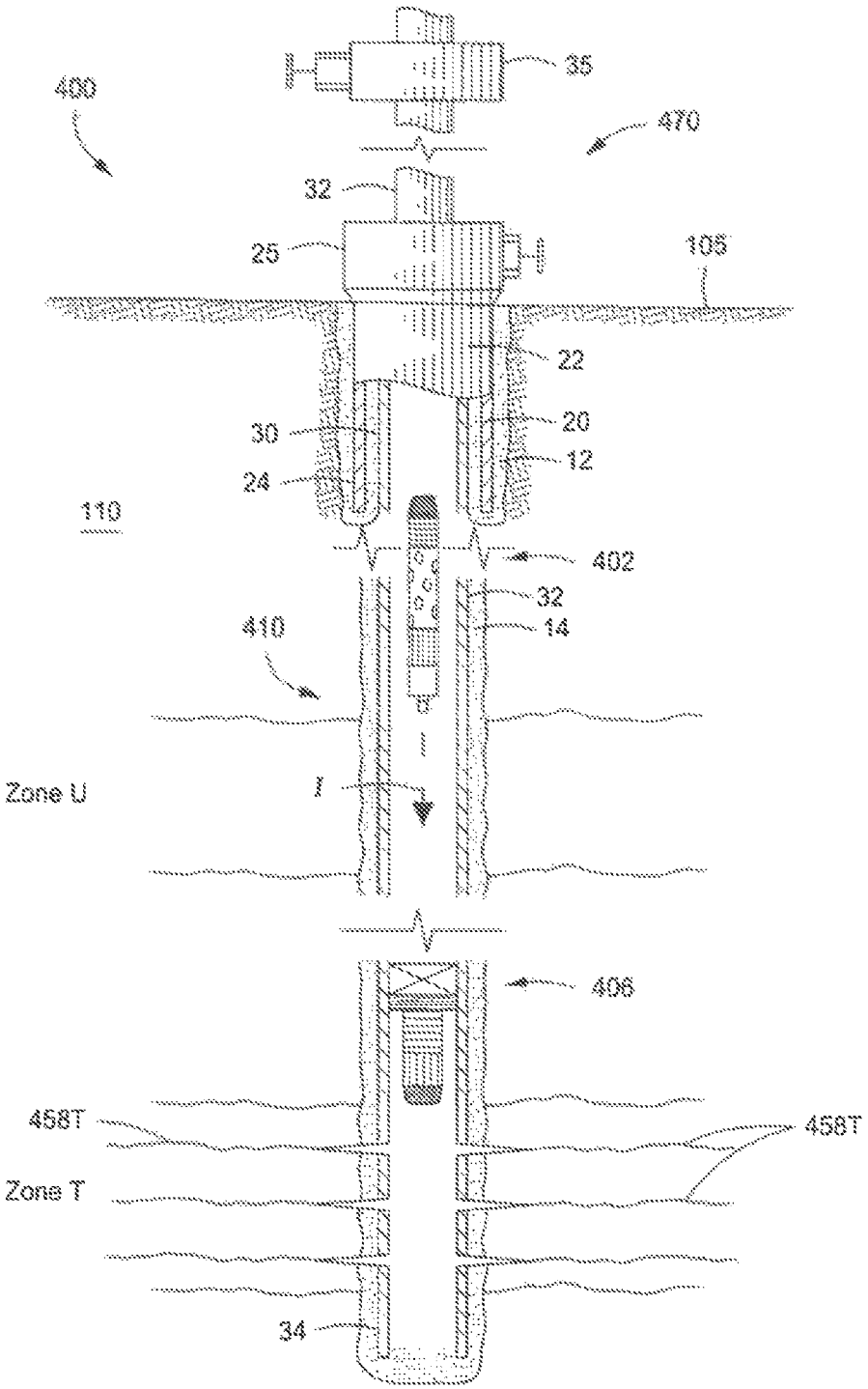
FIG. 4I is yet another side view of the well site of FIG. 4A. Here, the wellbore has received a second perforating gun assembly.

FIG. 4I is another side view of the well site 400 of FIG. 4A. Here, the wellbore 410 has received a second perforating gun assembly 402. The second perforating gun assembly 402 may be constructed and arranged as the first perforating gun assembly 401. This means that the second perforating gun assembly 402 is also autonomous.

It can be seen in FIG. 4I that the second perforating gun assembly 402 is moving downwardly in the wellbore 410, as indicated by arrow "I." The second perforating gun assembly 402 may be simply falling through the wellbore 410 in response to gravitational pull. In addition, the operator may be assisting the downward movement of the perforating gun assembly 402 by applying pressure through the use of surface pumps (not shown). Alternatively, the perforating gun assembly 402 may be aided in its downward movement through the use of a tractor (not shown). In this instance, the tractor will be fabricated entirely of a friable material.

Figure 4J:
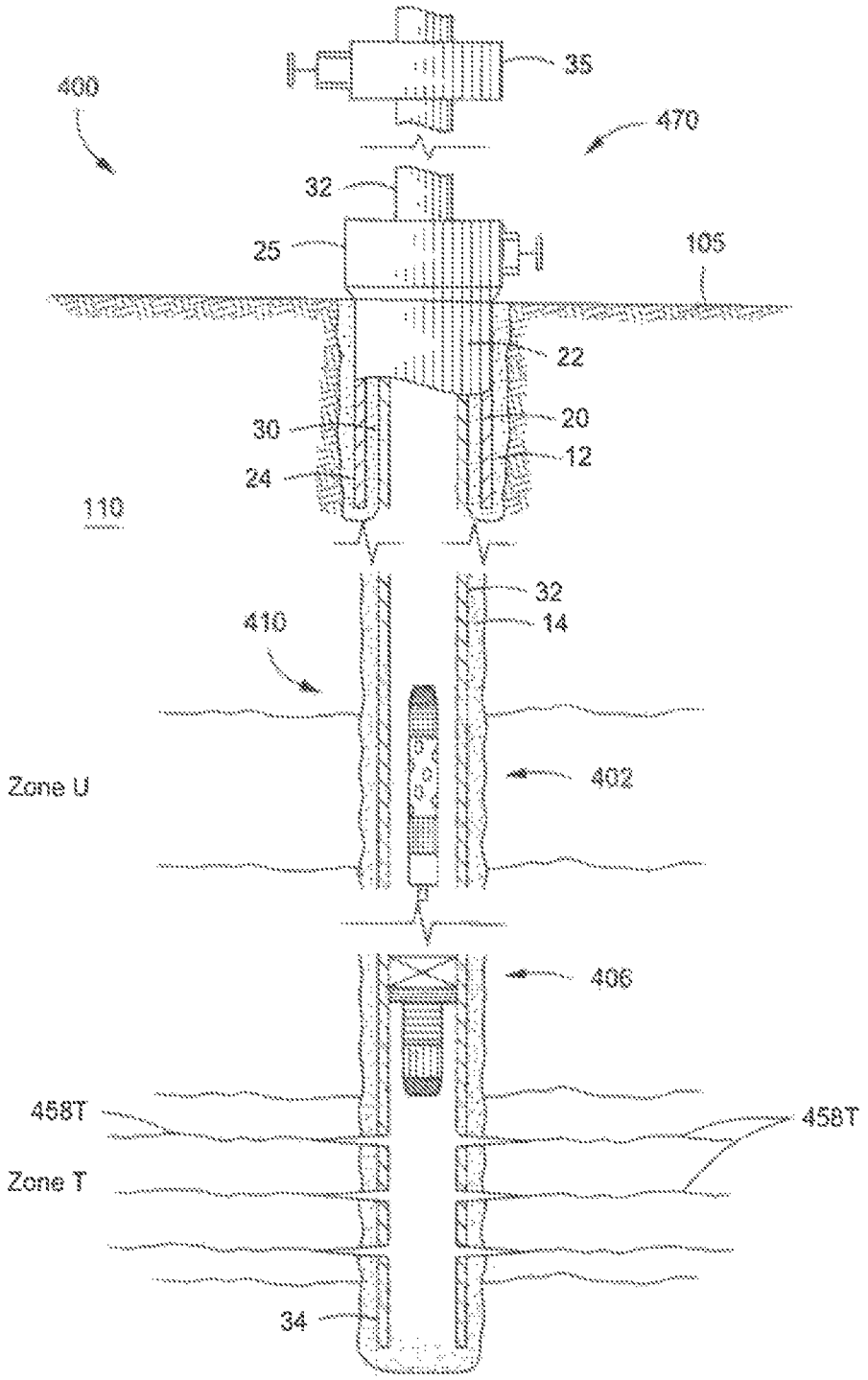
FIG. 4J is another side view of the well site of FIG. 4A. Here, the second perforating gun assembly has fallen in the wellbore to a position adjacent zone of interest "U." Zone of interest "U" is above zone of interest "T."

FIG. 4J is another side view of the well site 400 of FIG. 4A. Here, the second perforating gun assembly 402 has fallen in the wellbore to a position adjacent zone of interest "U." Zone of interest "U" is above zone of interest "T." In accordance with the present inventions, the locator device (shown at 314' in FIG. 3) has generated signals in response to tags placed along the production casing 30. In this way, the on-board controller (shown at 316 of FIG. 3) is aware of the location of the first perforating gun assembly 401.

Figure 4K:
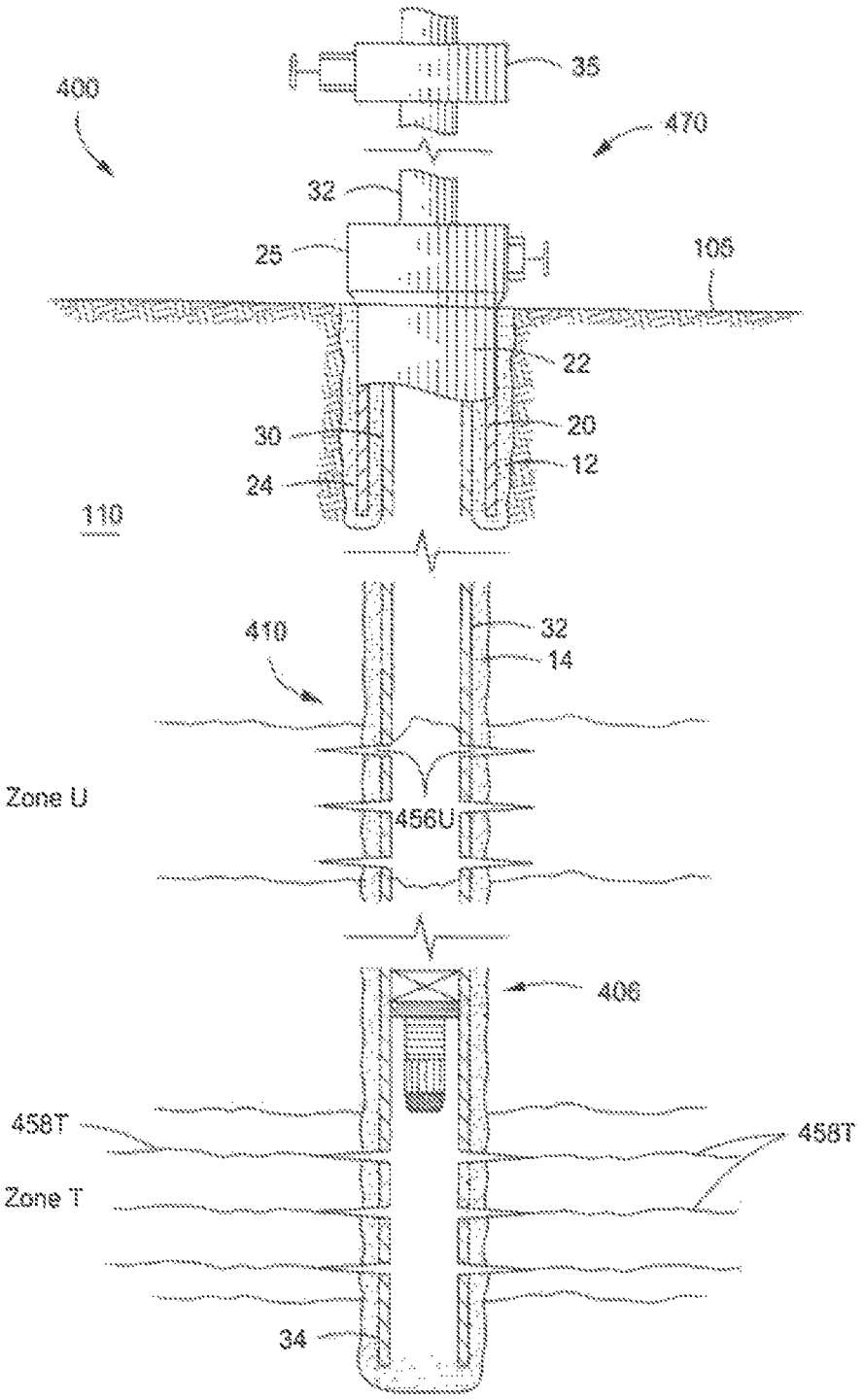
FIG. 4K is another side view of the well site of FIG. 4A. Here, charges of the second perforating gun assembly have been detonated, causing the perforating gun of the perforating gun assembly to fire. The casing along the zone of interest "U" has been perforated.

FIG. 4K is another side view of the well site 400 of FIG. 4A. Here, charges of the second perforating gun assembly 402 have been detonated, causing the perforating gun of the perforating gun assembly to fire. The zone of interest "U" has been perforated. A set of perforations 456U is shown extending from the wellbore 410 and into the subsurface 110. While only six perforations 456U are shown in side view, it us understood that additional perforations are formed, and that such perforations will extend radially around the production casing 30.

In addition to the creation of perforations 456U, the second perforating gun assembly 402 is self-destructed. Any pieces left from the assembly 402 will likely fall to the plug assembly 406 still set in the production casing 30.

Figure 4L:
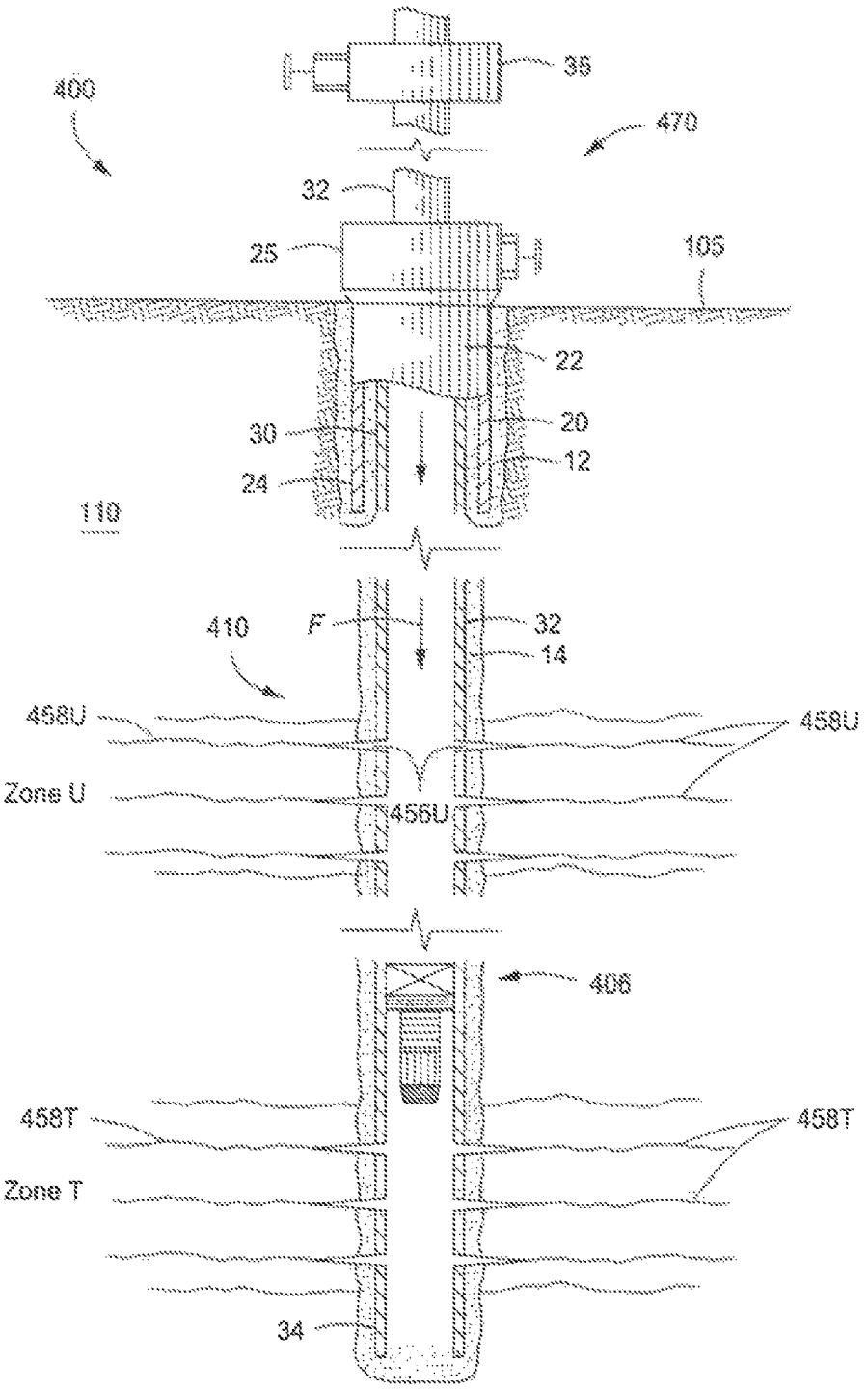
FIG. 4L is still another side view of the well site of FIG. 4A. Here, fluid is being injected into the wellbore under high pressure, causing the formation within the zone of interest "U" to be fractured.

FIG. 4L is yet another side view of the well site 400 of FIG. 4A. Here, fluid is being injected into the bore 405 of the wellbore 410 under high pressure. The fluid injection causes the subsurface 110 within the zone of interest "A" to be fractured. Downward movement of the fluid is indicated by arrows "F." The fluid moves through the perforations 456A and into the surrounding subsurface 110. This causes fractures 458U to be formed within the zone of interest "U." An acid solution may also optionally be circulated into the bore 405 to remove carbonate build-up and remaining drilling mud and further stimulate the subsurface 110 for hydrocarbon production.

Figure 4M:
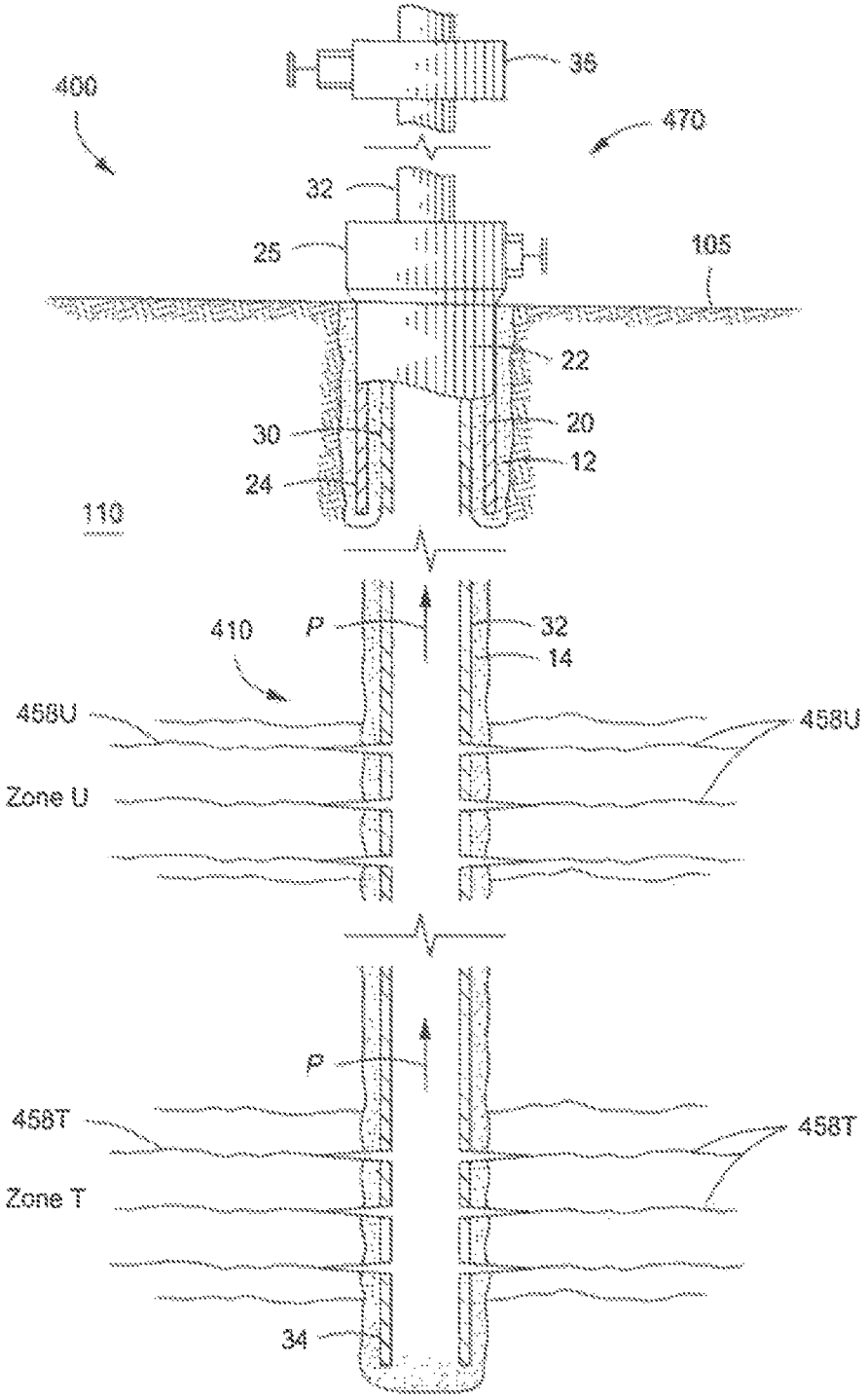
FIG. 4M provides a final side view of the well site of FIG. 4A. Here, the fracturing plug assembly has been removed from the wellbore. In addition, the wellbore is now receiving production fluids.

Finally, FIG. 4M provides a final side view of the well site 400 of FIG. 4A. Here, the fracturing plug assembly 406 has been removed from the wellbore 410. In addition, the wellbore 410 is now receiving production fluids. Arrows "P" indicate the flow of production fluids from the subsurface 110 into the wellbore 410 and towards the surface 105.

In order to remove the plug assembly 406, the on-board controller (shown at 216 of FIG. 2) may release the plug body 200" (with the slips 213") after a designated period of time. The fracturing plug assembly 406 may then be flowed back to the surface 105 and retrieved via a pig catcher (not shown) or other such device. Alternatively, the on-board controller 216 may be programmed so that after a designated period of time, a detonating cord is ignited, which then causes the fracturing plug assembly 406 to detonate and self-destruct. In this arrangement, the entire fracturing plug assembly 406 is fabricated from a friable material.

FIGS. 4A through 4M demonstrate the use of perforating gun assemblies with a fracturing plug to perforate and stimulate two separate zones of interest (zones "T" and "U") within an illustrative wellbore 410. In this example, both the first 401 and the second 402 perforating gun assemblies were autonomous, and the fracturing plug assembly 406 was also autonomous. However, it is possible to perforate the lowest or terminal zone "T" using a traditional wireline with a select-fire gun assembly, but then use autonomous perforating gun assemblies to perforate multiple zones above the terminal zone "T."

Other combinations of wired and wireless tools may be used within the spirit of the present inventions. For example, the operator may run the fracturing plugs into the wellbore on a wireline, but use one or more autonomous perforating gun assemblies. Reciprocally, the operator may run the respective perforating gun assemblies into the wellbore on a wireline, but use one or more autonomous fracturing plug assemblies.

Figure 5A:
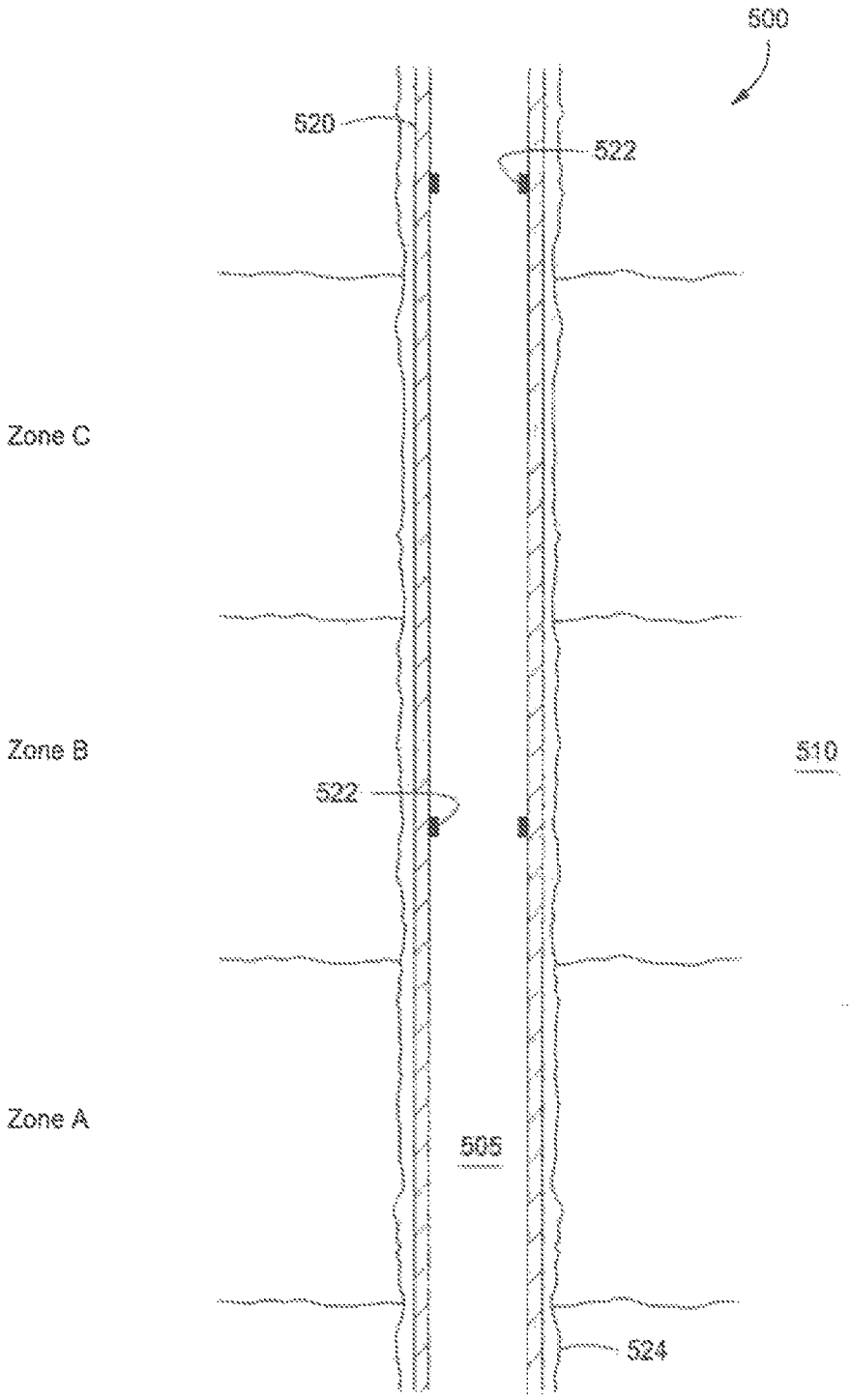
FIG. 5A is a side view of a portion of a wellbore. The wellbore is being completed in multiple zones of interest, including zones "A," "B," and "C."

In another arrangement, the perforating steps may be done without a fracturing plug assembly. FIGS. 5A through 5I demonstrate how multiple zones of interest may be sequentially perforated and treated in a wellbore using destructible, autonomous perforating gun assemblies and ball sealers. First, FIG. 5A is a side view of a portion of a wellbore 500. The wellbore 500 is being completed in multiple zones of interest, including zones "A," "B," and "C." The zones of interest "A," "B," and "C" reside within a subsurface 510 containing hydrocarbon fluids.

The wellbore 500 includes a string of production casing (or, alternatively, a liner string) 520. The production casing 520 has been cemented into the subsurface 510 to isolate the zones of interest "A," "B," and "C" as well as other strata along the subsurface 510. A cement sheath is seen at 524.

The production casing 520 has a series of locator tags 522 placed there along. The locator tags 522 are ideally embedded into the wall of the production casing 520 to preserve their integrity. However, for illustrative purposes the locator tags 522 are shown in FIG. 5A as attachments along the inner diameter of the production casing 520. In the arrangement of FIG. 5A, the locator tags 512 represent radio frequency identification tags that are sensed by an RFID reader/antennae. The locator tags 522 create a physical signature along the wellbore 500.

The wellbore 500 is part of a well that is being formed for the production of hydrocarbons. As part of the well completion process, it is desirable to perforate and then fracture each of the zones of interest "A," "B," and "C."

Figure 5B:
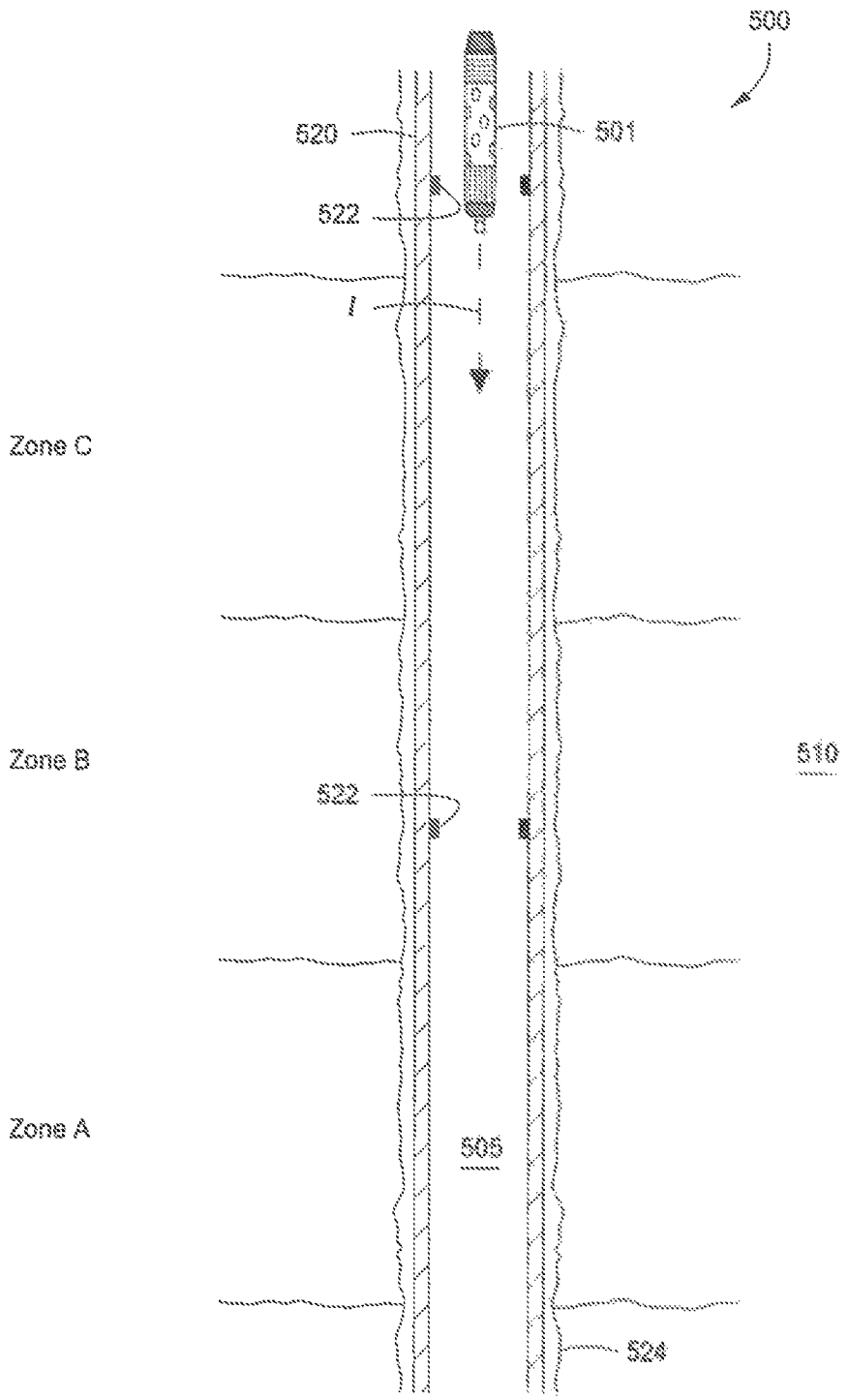
FIG. 5B is another side view of the wellbore of FIG. 5A. Here, the wellbore has received a first perforating gun assembly. The perforating gun assembly is being pumped down the wellbore.

FIG. 5B is another side view of the wellbore 500 of FIG. 5A. Here, the wellbore 500 has received a first perforating gun assembly 501. The first perforating gun assembly 501 is generally in accordance with perforating gun assembly 300' (in its various embodiments) of FIG. 3. In FIG. 5B, the perforating gun assembly 501 is being pumped down the wellbore 500. The perforating gun assembly 501 has been dropped into a bore 505 of the wellbore 500, and is moving down the wellbore 500 through a combination of gravitational pull and hydraulic pressure. Arrow "I" indicates movement of the gun assembly 501.

Figure 5C:
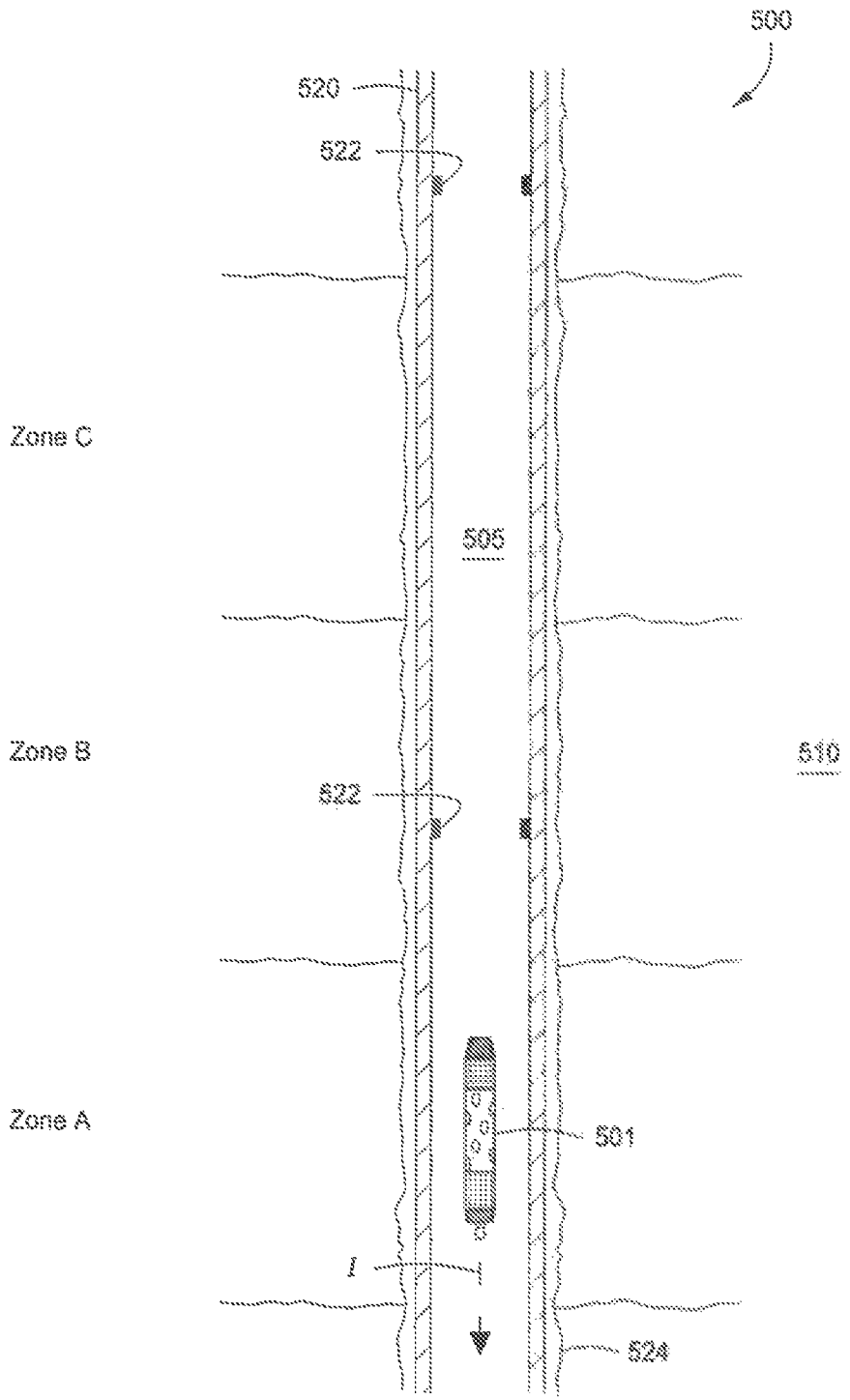
FIG. 5C is another side view of the wellbore of FIG. 5A. Here, the first perforating gun assembly has fallen into the wellbore to a position adjacent zone of interest "A."

FIG. 5C is a next side view of the wellbore 500 of FIG. 5A. Here, the first perforating gun assembly 501 has fallen into the bore 505 to a position adjacent zone of interest "A." In accordance with the present inventions, the locator device (shown at 314' in FIG. 3) has generated signals in response to the tags 522 placed along the production casing 30. In this way, the on-board controller (shown at 316 of FIG. 3) is aware of the location of the first perforating gun assembly 501.

Figure 5D:
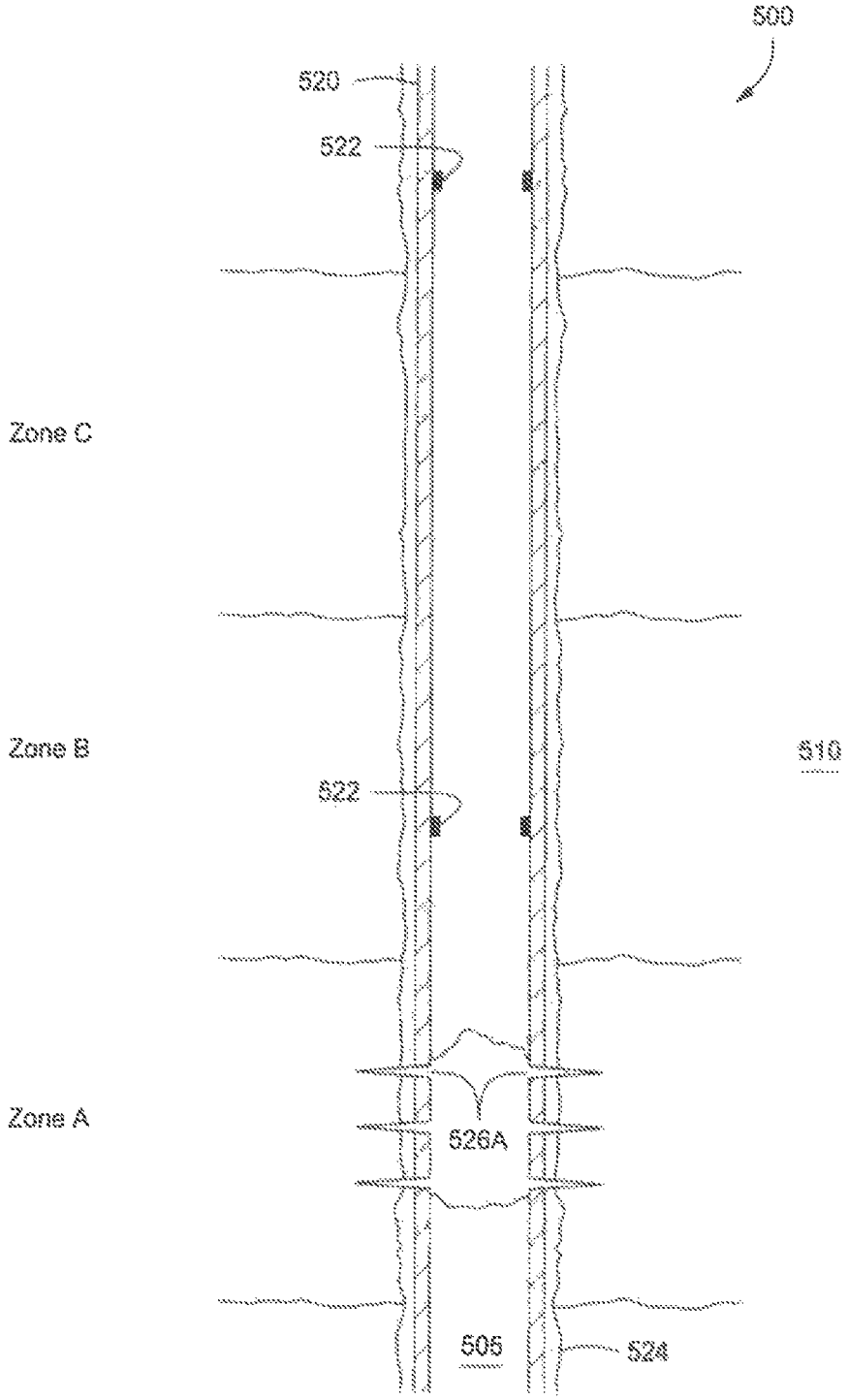
FIG. 5D is another side view of the wellbore of FIG. 5A. Here, charges of the first perforating gun assembly have been detonated, causing the perforating gun of the perforating gun assembly to fire. The casing along the zone of interest "A" has been perforated.

FIG. 5D is another side view of the wellbore 500 of FIG. 5A. Here, charges of the first perforating gun assembly have been detonated, causing the perforating gun of the perforating gun assembly to fire. The zone of interest "A" has been perforated. A set of perforations 526A is shown extending from the wellbore 500 and into the subsurface 510. While only six perforations 526A are shown in side view, it us understood that additional perforations are formed, and that such perforations will extend radially around the production casing 30.

In addition to the creation of perforations 526A, the first perforating gun assembly 501 is self-destructed. Any pieces left from the assembly 501 will likely fall to the bottom of the production casing 30.

Figure 5E:
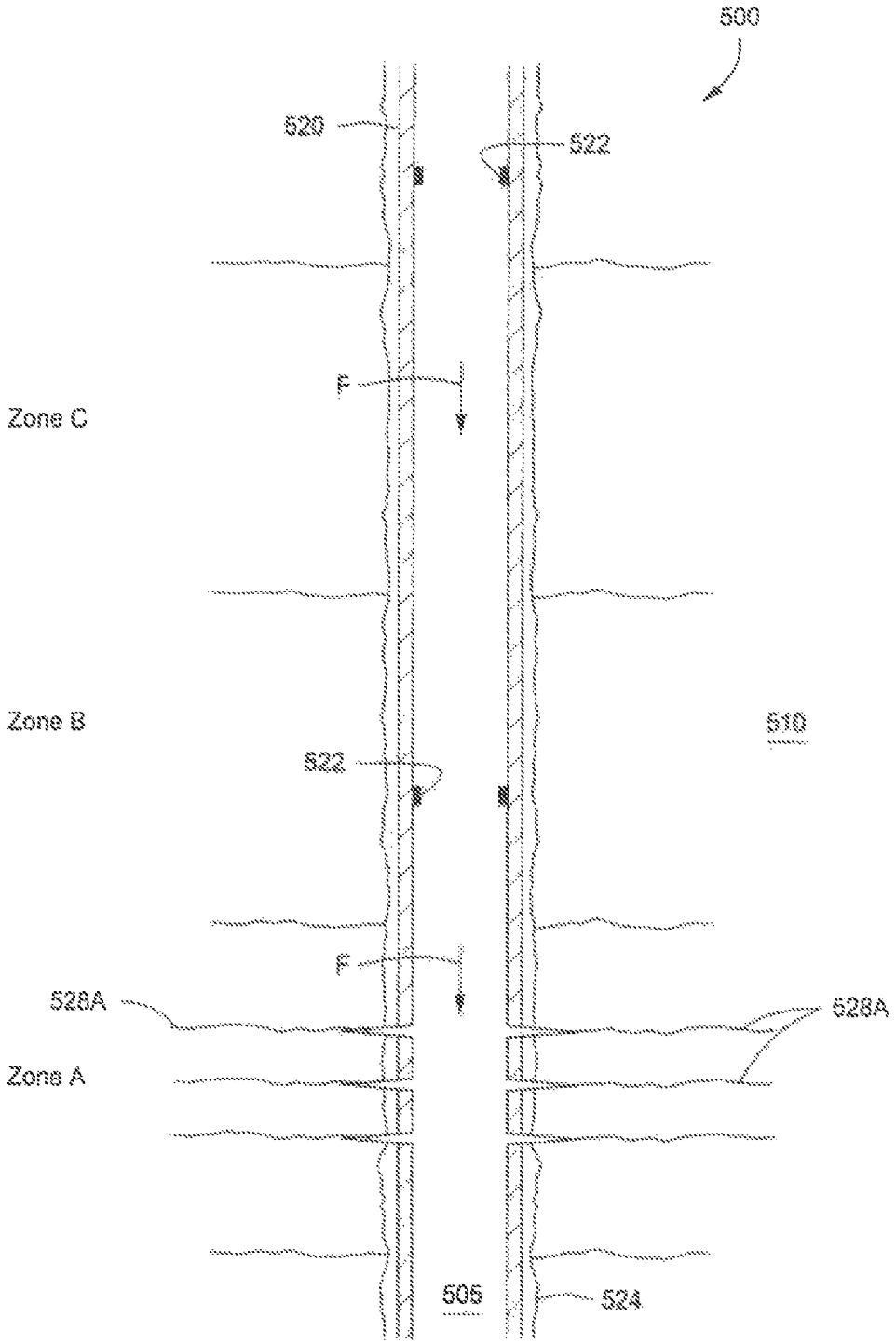
FIG. 5E is yet another side view of the wellbore of FIG. 5A. Here, fluid is being injected into the wellbore under high pressure, causing the rock matrix within the zone of interest "A" to be fractured.

FIG. 5E is yet another side view of the wellbore 500 of FIG. 5A. Here, fluid is being injected into the bore 505 of the wellbore under high pressure, causing the formation within the zone of interest "A" to be fractured. Downward movement of the fluid is indicated by arrows "F." The fluid moves through the perforations 526A and into the surrounding subsurface 110. This causes fractures 528A to be formed within the zone of interest "A." An acid solution may also optionally be circulated into the bore 505 to dissolve drilling mud and to remove carbonate build-up and further stimulate the subsurface 110 for hydrocarbon production.

Figure 5F:
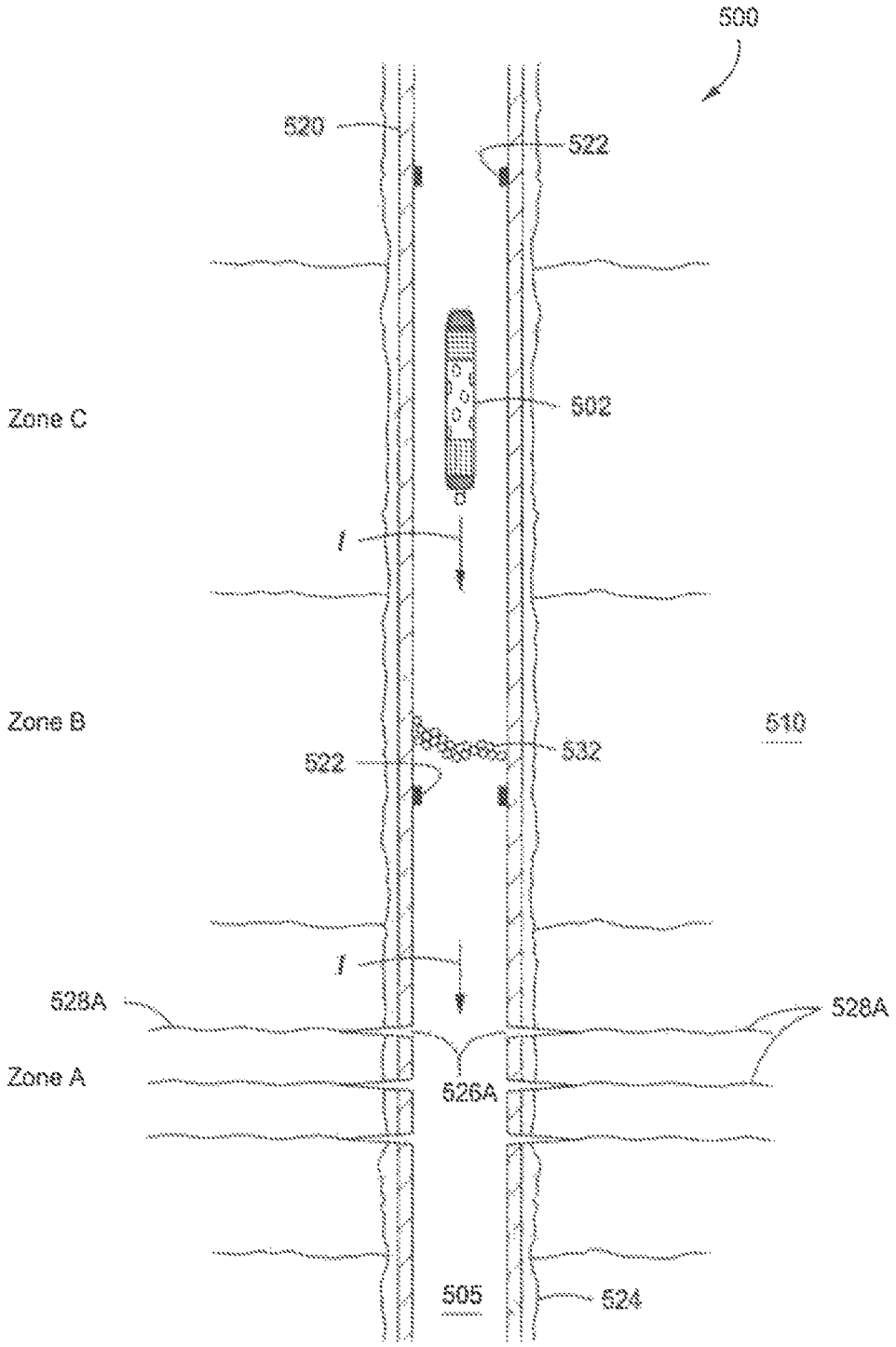
FIG. 5F is yet another side view of the wellbore of FIG. 5A. Here, the wellbore has received a second perforating gun assembly. In addition, ball sealers have been dropped into the wellbore ahead of the second perforating gun assembly.

FIG. 5F is yet another side view of the wellbore 500 of FIG. 5A. Here, the wellbore 500 has received a second perforating gun assembly 502. The second perforating gun assembly 502 may be constructed and arranged as the first perforating gun assembly 501. This means that the second perforating gun assembly 502 is also autonomous, and is also constructed of a friable material.

It can be seen in FIG. 5F that the second perforating gun assembly 502 is moving downwardly in the wellbore 500, as indicated by arrow "I." The second perforating gun assembly 502 may be simply falling through the wellbore 500 in response to gravitational pull. In addition, the operator may be assisting the downward movement of the perforating gun assembly 502 by applying hydraulic pressure through the use of surface pumps (not shown).

In addition to the gun assembly 502, ball sealers 532 have been dropped into the wellbore 500. The ball sealers 532 are preferably dropped ahead of the second perforating gun assembly 502. Optionally, the ball sealers 532 are released from a ball container (shown at 318 in FIG. 3). The ball sealers 532 are fabricated from composite material and are rubber coated. The ball sealers 532 are dimensioned to plug the perforations 526A.

The ball sealers 532 are intended to be used as a diversion agent. The concept of using ball sealers as a diversion agent for stimulation of multiple perforation intervals is known. The ball sealers 532 will seat on the perforations 526A, thereby plugging the perforations 526A and allowing the operator to inject fluid under pressure into a zone above the perforations 526A. The ball sealers 532 provide a low-cost diversion technique, with a low risk of mechanical issues.

Figure 5G:
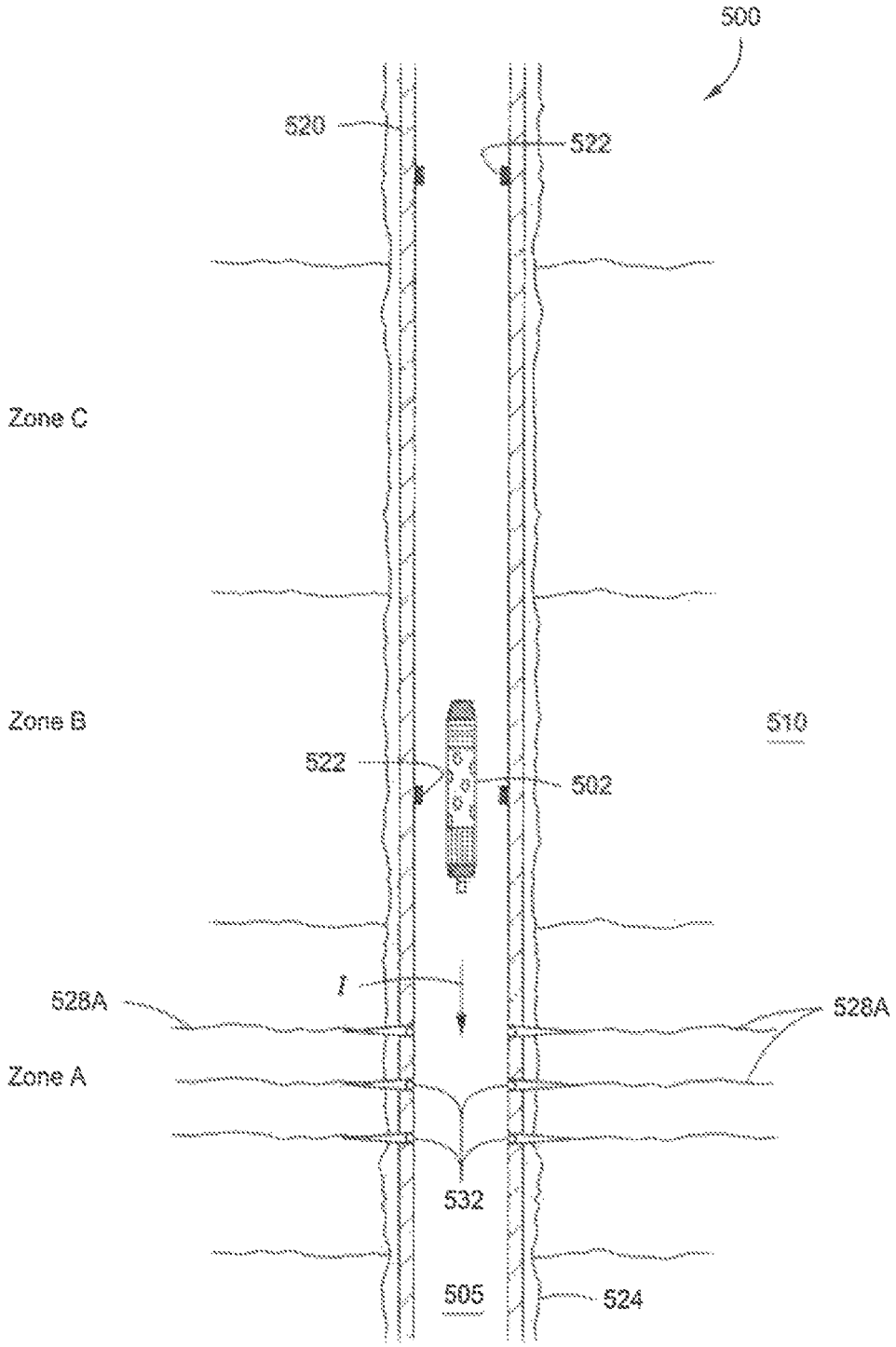
FIG. 5G is still another side view of the wellbore of FIG. 5A. Here, the second fracturing plug assembly has fallen into the wellbore to a position adjacent the zone of interest "B." In addition, the ball sealers have plugged the newly-formed perforations along the zone of interest "A."

FIG. 5G is still another side view of the wellbore 500 of FIG. 5A. Here, the second fracturing plug assembly 501 has fallen into the wellbore 500 to a position adjacent the zone of interest "B." In addition, the ball sealers 532 have temporarily plugged the newly-formed perforations along the zone of interest "A." The ball sealers 532 will later either flow out with produced hydrocarbons, or drop to the bottom of the well in an area known as the rat (or junk) hole.

Figure 5H:
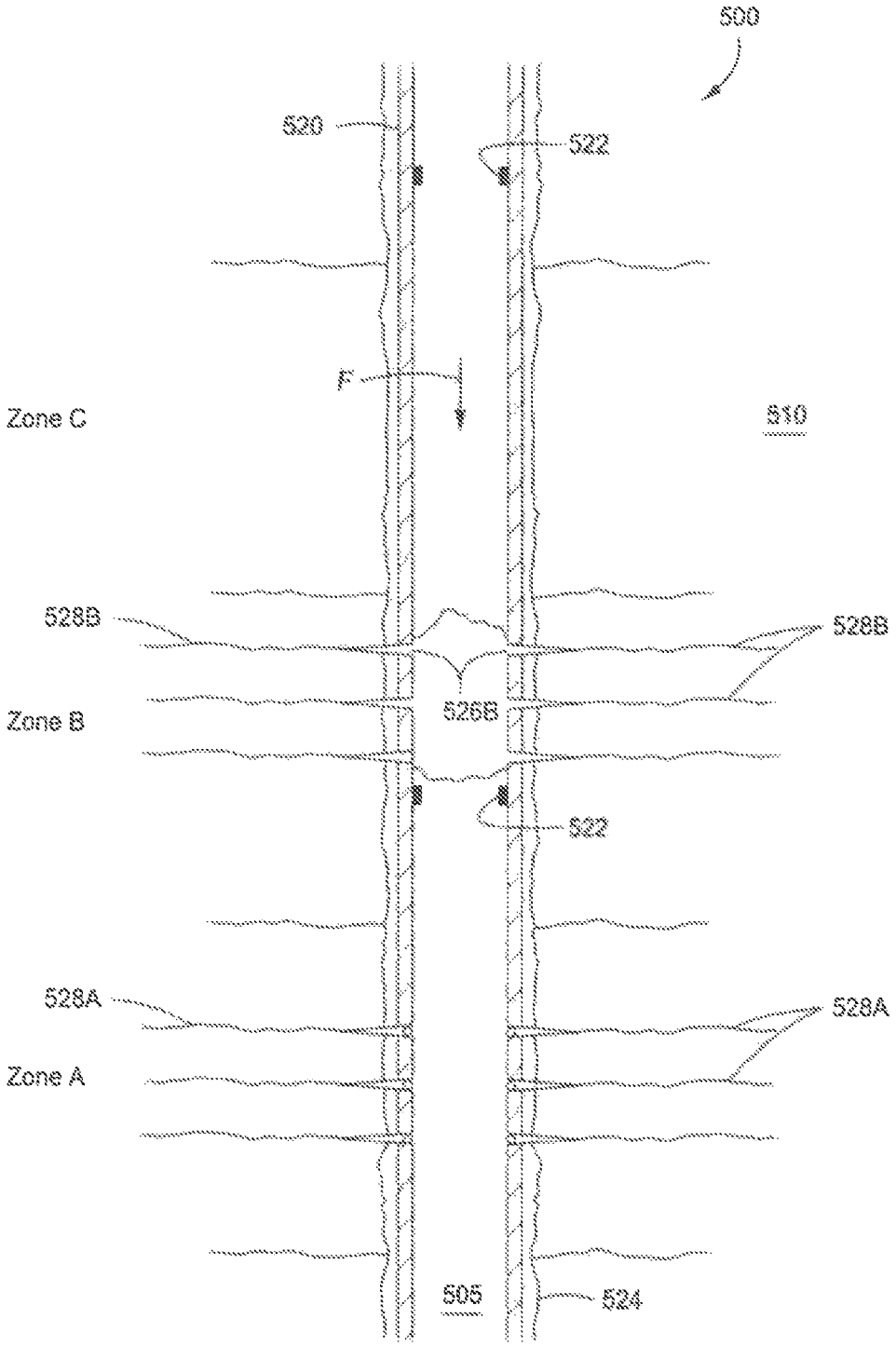
FIG. 5H is another side view of the wellbore of FIG. 5A. Here, the charges of the second perforating gun assembly have been detonated, causing the perforating gun of the perforating gun assembly to fire. The casing along the zone of interest "B" has been perforated. Zone "B" is above zone of interest "A." In addition, fluid is being injected into the wellbore under high pressure, causing the rock matrix within the zone of interest "B" to be fractured.

FIG. 5H is another side view of the wellbore 500 of FIG. 5A. Here, charges of the second perforating gun assembly 502 have been detonated, causing the perforating gun of the perforating gun assembly 502 to fire. The zone of interest "B" has been perforated. A set of perforations 456B is shown extending from the wellbore 500 and into the subsurface 510. While only 6 perforations 456A are shown in side view, it us understood that additional perforations are formed, and that such perforations will extend radially around the production casing 30.

In addition to the creation of perforations 456B, the perforating gun assembly 502 is self-destructed. Any pieces left from the assembly 501 will likely fall to the bottom of the production casing 30 or later flow back to the surface.

It is also noted in FIG. 5H that fluid continues to be injected into the bore 505 of the wellbore 500 while the perforations 526B are being formed. Fluid flow is indicated by arrow "F." Because ball sealers 532 are substantially plugging the lower perforations along zone "A," pressure is able to build up in the wellbore 500. Once the perforations 526B are shot, the fluid escapes the wellbore 500 and invades the subsurface 510 within zone "B." This immediately creates fractures 528B.

It is understood that the process used for forming perforations 526B and formation fractures 528B along zone of interest "B" may be repeated in order to form perforations and formation fractures in zone of interest "C," and other higher zones of interest. This would include the placement of ball sealers along perforations 528B at zone "B," running a third autonomous perforating gun assembly (not shown) into the wellbore 500, causing the third perforating gun assembly to detonate along zone of interest "C," and creating perforations and formation fractures along zone "C."

Figure 5I:
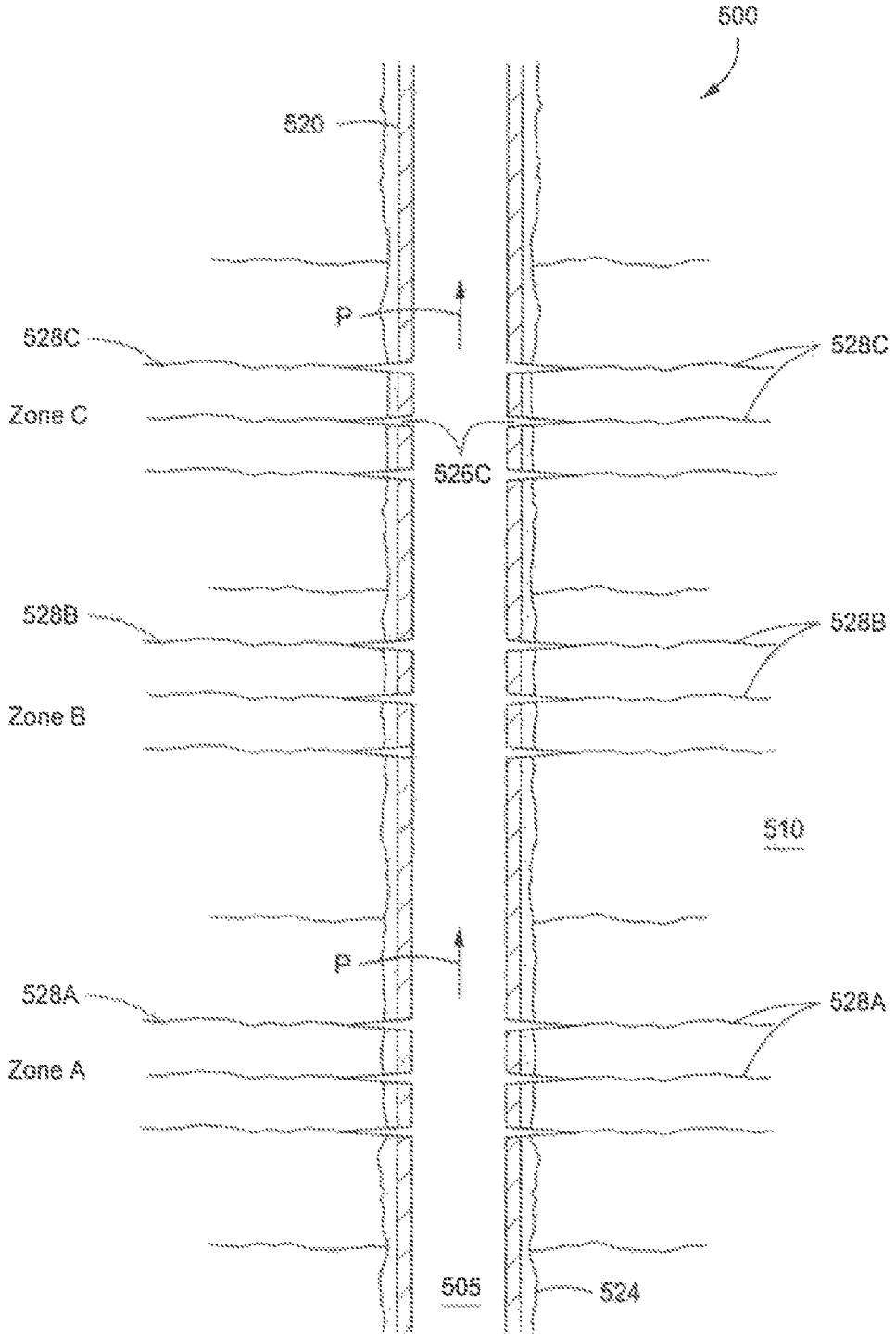
FIG. 5I provides a final side view of the wellbore of FIG. 5A. Here, the production casing has been perforated along zone of interest "C." Multiple sets of perforations are seen. In addition, formation fractures have been formed in the subsurface along zone "C." The ball sealers have been flowed back to the surface.

FIG. 5I provides a final side view of the wellbore 500 of FIG. 5A. Here, the production casing 520 has been perforated along zone of interest "C." Multiple sets of perforations 526C are seen. In addition, formation fractures 528C have been formed in the subsurface 510.

In FIG. 5I, the wellbore 500 has been placed in production. The ball sealers have been removed and have flowed to the surface. Formation fluids are flowing into the bore 505 and up the wellbore 500. Arrows "P" indicate a flow of fluids towards the surface.

FIGS. 5A through 5I demonstrate how perforating gun assemblies may be dropped into a wellbore 500 sequentially, with the on-board controller of each perforating gun assembly being programmed to ignite its respective charges at different selected depths. In the depiction of FIGS. 5A through 5I, the perforating gun assemblies are dropped in such a manner that the lowest zone (Zone "A") is perforated first, followed by sequentially shallower zones (Zone "B" and then Zone "C"). However, using autonomous perforating gun assemblies, the operator may perforate subsurface zones in any order. Beneficially, perforating gun assemblies may be dropped in such a manner that subsurface zones are perforated from the top, down. This means that the perforating gun assemblies would detonate in the shallower zones before detonating in the deeper zones.

It is also noted that FIGS. 5A through 5I demonstrate the use of a perforating gun assembly and a fracturing plug assembly as autonomous tool assemblies. However, additional actuatable tools may be used as part of an autonomous tool assembly. Such tools include, for example, bridge plugs, cutting tools, cement retainers and casing patches. In these arrangements, the tools will be dropped or pumped or carried into a wellbore constructed to produce hydrocarbon fluids or to inject fluids. The tool may be fabricated from a friable material or from a millable material.

Figure 6:
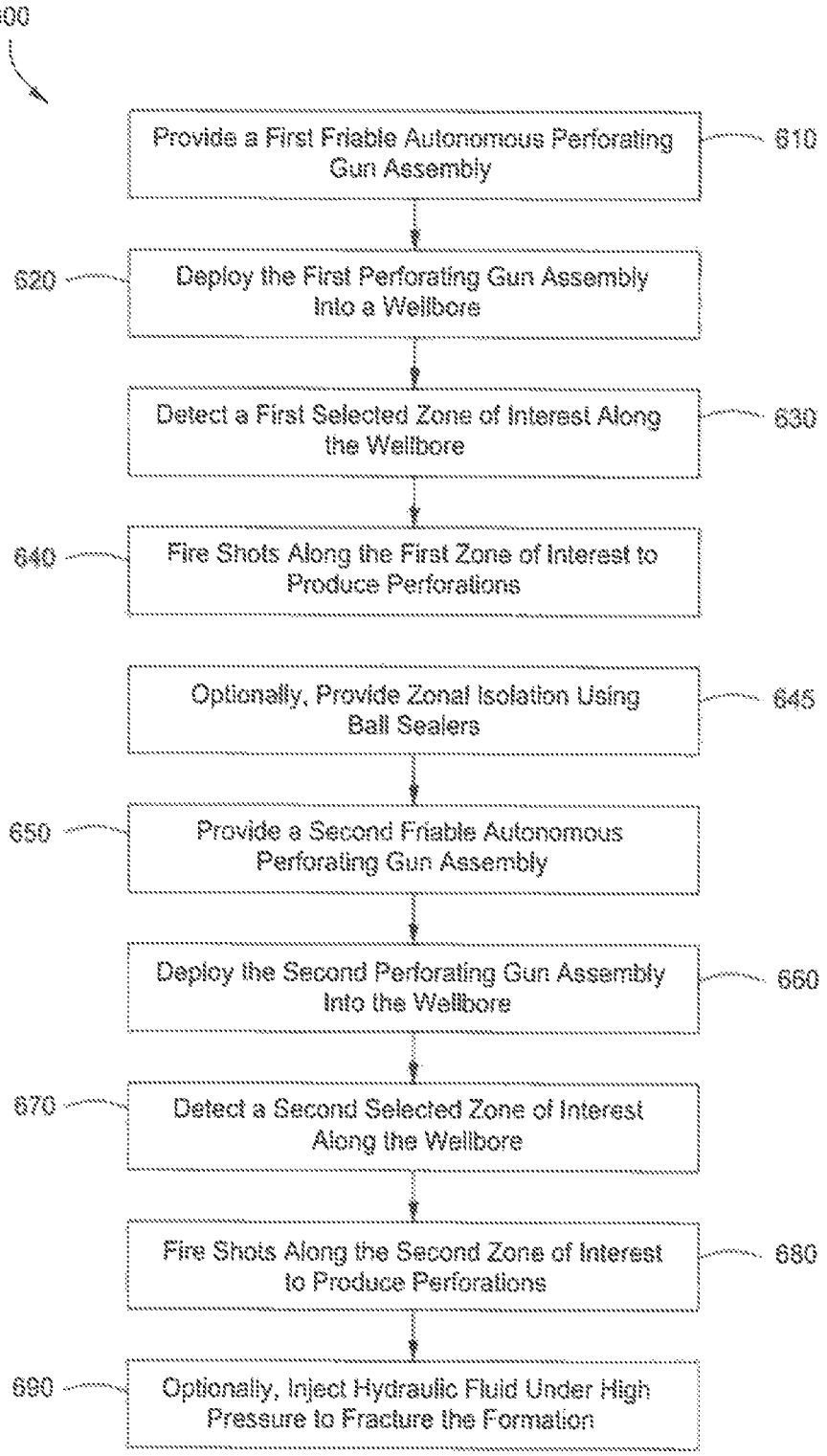
FIG. 6 is a flowchart showing steps for completing a wellbore using autonomous tools, in one embodiment.

FIG. 6 is a flowchart showing steps for a method 600 for completing a wellbore using autonomous tools, in one embodiment. In accordance with the method 600, the wellbore is completed along multiple zones of interest. A string of production casing (or liner) has been run into the wellbore, and the production casing has been cemented into place.

The method 600 first includes providing a first autonomous perforating gun assembly. This is shown in Box 610. The first autonomous perforating gun assembly is manufactured in accordance with the perforating gun assembly 300' described above, in its various embodiments. The first autonomous perforating gun assembly is substantially fabricated from a friable material, and is designed to self-destruct, preferably upon detonation of charges.

The method 600 next includes deploying the first perforating gun assembly into the wellbore. This is seen at Box 620. The first perforating gun assembly is configured to detect a first selected zone of interest along the wellbore. Thus, as the first perforating gun assembly is pumped or otherwise falls down the wellbore, it will monitor its depth or otherwise determine when it has arrived at the first selected zone of interest.

The method 600 also includes detecting the first selected zone of interest along the wellbore. This is seen at Box 630. In one aspect, detecting is accomplished by pre-loading a physical signature of the wellbore. The perforating gun assembly seeks to match the signature as it traverses through the wellbore. The perforating gun assembly ultimately detects the first selected zone of interest by matching the physical signature. The signature may be matched, for example, by counting casing collars, by counting RFID tags, by detecting a particular cluster of tags, by detecting specially-placed magnets, or other means.

The method 600 further includes firing shots along the first zone of interest. This is provided at Box 640. Firing shots produces perforations. The shots penetrate a surrounding string of production casing and extend into the subsurface formation.

The method 600 also includes providing a second autonomous perforating gun assembly. This is seen at Box 650. The second autonomous perforating gun assembly is also manufactured in accordance with the perforating gun assembly 300' described above, in its various embodiments. The second autonomous perforating gun assembly is also substantially fabricated from a friable material, and is designed to self-destruct upon detonation of charges.

The method 600 further includes deploying the first perforating gun assembly into the wellbore. This is seen at Box 660. The second perforating gun assembly is configured to detect a second selected zone of interest along the wellbore. Thus, as the second perforating gun assembly is pumped or otherwise falls down the wellbore, it will monitor its depth or otherwise determine when it has arrived at the second selected zone of interest.

The method 600 also includes detecting the second selected zone of interest along the wellbore. This is seen at Box 670. Detecting may again be accomplished by pre-loading a physical signature of the wellbore. The perforating gun assembly seeks to match the signature as it traverses through the wellbore. The perforating gun assembly ultimately detects the second selected zone of interest by matching the physical signature.

The method 600 further includes firing shots along the second zone of interest. This is provided in Box 680. Firing shots produces perforations. The shots penetrate the surrounding string of production casing and extend into the subsurface formation. Preferably, the second zone of interest is above the first zone of interest, although it may be below the first zone of interest.

The method 600 may optionally include injecting hydraulic fluid under high pressure to fracture the formation. This is shown at Box 690. The formation may be fractured by directing fluid through perforations along the first selected zone of interest, by directing fluid through perforations along the second selected zone of interest, or both. Preferably, the fluid contains proppant.

Where multiple zones of interest are being perforated and fractured, it is desirable to employ a diversion agent. Acceptable diversion agents may include the autonomous fracturing plug assembly 200' described above, and the ball sealers 532 described above. Thus, one optional step is to provide zonal isolation using ball sealers. This is shown at Box 645. The ball sealers are pumped downhole to seal off the perforations, and may be placed in a leading flush volume. In one aspect, the ball sealers are carried downhole in a container, and released via command from the on-board controller below the second perforating gun assembly.

As an alternative diversion agent, a so-called "frac baffle" may be set with each perforating gun assembly deployment, such that a single frac ball can be used instead of multiple ball sealers to isolate a just-treated zone. To set a frac baffle, a seat has to be installed in the casing before cementing. The seat is sized to accept a sealing ball of specific size. The frac ball provides fluid diversion to the next fracture stimulation treatment.

It may also be desirable for the operator to circulate an acid solution after perforating and fracturing each zone. The diversion agent will be used in such an operation as well.

The steps of Box 650 through Box 690 may be repeated numerous times for multiple zones of interest. A diversion technique may not be required for every set of perforations, but may possibly be used only after several zones have been perforated.

The method 600 is applicable for vertical, inclined, and horizontally completed wells. The type of the well will determine the delivery method of and sequence for the autonomous tools. In vertical and low-angle wells, the force of gravity may be sufficient to ensure the delivery of the assemblies to the desired depth or zone. In higher angle wells, including horizontally completed wells, the assemblies may be pumped down or delivered using tractors. To enable pumping down of the first assembly, the casing may be perforated at the toe of the well.

It is also noted that the method 600 has application for the completion of both production wells and injection wells.

Finally, a combination of a fracturing plug assembly 200' and a perforating gun assembly 300' may be deployed together as an autonomous unit, or as a line-tethered unit, such that in either embodiment, at least one of the gun and the plug of the combined unit is configured for autonomous actuation at the selected depth or zone. Such a combination adds further optimization of equipment utilization. In this combination, the plug assembly 200' is set, then the perforating gun of the perforating gun assembly 300' fires directly above the plug assembly.

Figure 7A:
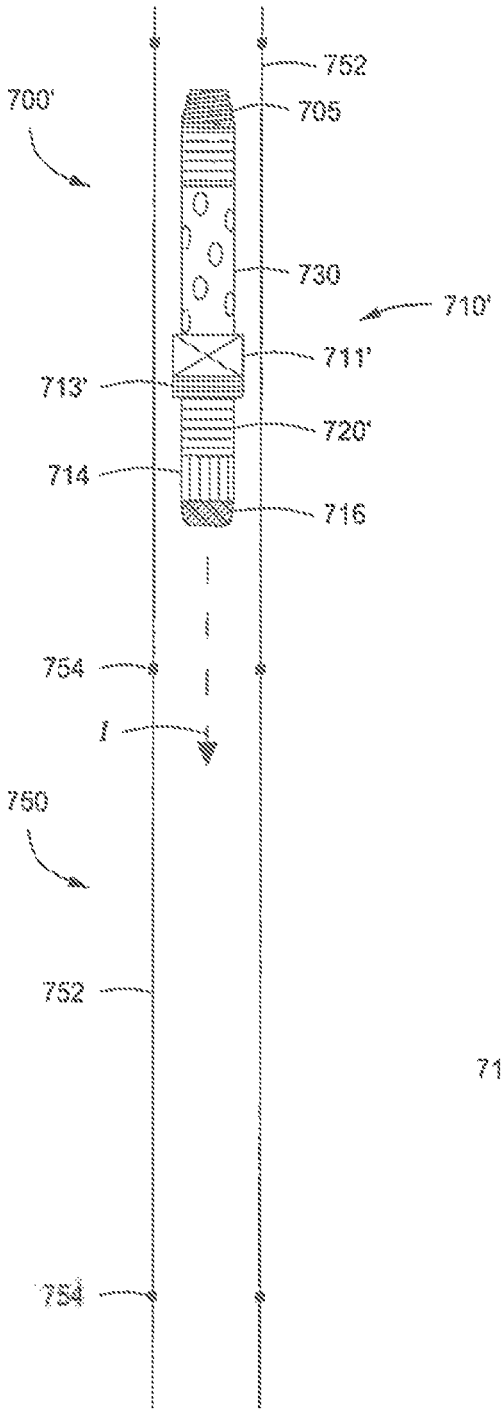
FIGS. 7A and 7B present side views of a lower portion of a wellbore receiving an integrated tool assembly for performing a wellbore operation. The wellbore is being completed in a single zone.
Figure 7B:
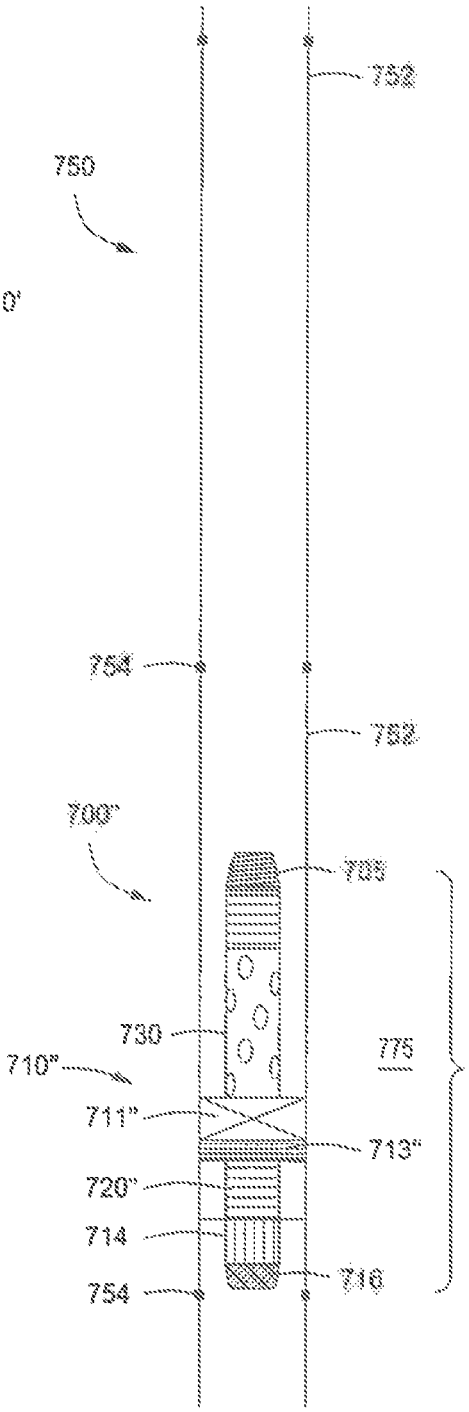

FIGS. 7A and 7B demonstrate such an arrangement. First, FIG. 7A provides a side view of a lower portion of a wellbore 750. The illustrative wellbore 750 is being completed in a single zone. A string of production casing is shown schematically at 752. An autonomous tool 700' has been dropped down the wellbore 750 through the production casing 752. Arrow "I" indicates the movement of the tool 700' traveling downward through the wellbore 750.

The autonomous tool 700' represents a combined plug assembly and perforating gun assembly. This means that the single tool 700' comprises components from both the plug assembly 200' and the perforating gun assembly 300' of FIGS. 2 and 3, respectively.

First, the autonomous tool 700' includes a plug body 710'. The plug body 710' will preferably define an elastomeric sealing element 711' and a set of slips 713'. The autonomous tool 700' also includes a setting tool 720'. The setting tool 720' will actuate the sealing element 711' and the slips 713', and translate them radially to contact the casing 752.

In the view of FIG. 7A, the plug body 710' has not been actuated. Thus, the tool 700' is in a run-in position. In operation, the sealing element 711' of the plug body 710' may be mechanically expanded in response to a shift in a sleeve or other means as is known in the art. This allows the sealing element 711' to provide a fluid seal against the casing 752. At the same time, the slips 713' of the plug body 710' ride outwardly from the assembly 700' along wedges (not shown) spaced radially around the assembly 700'. This allows the slips 713' to extend radially and "bite" into the casing 752, securing the tool assembly 700' in position against downward hydraulic force.

The autonomous tool 700' also includes a position locator 714. The position locator 714 serves as a location device for sensing the location of the tool 700' within the production casing 750. More specifically, the position locator 714 senses the presence of objects or "tags" along the wellbore 750, and generates depth signals in response. In the view of FIG. 7A, the objects are casing collars 754. This means that the position locator 714 is a casing collar locator, or "CCL." The CCL senses the location of the casing collars 754 as it moves down the wellbore 750.

As with the plug assembly 200' described above in FIG. 2, the position locator 714 may sense other objects besides casing collars. Alternatively, the position locator 714 may be programmed to locate a selected depth using an accelerometer.

The tool 700' also includes a perforating gun 730. The perforating gun 730 may be a select fire gun that fires, for example, 16 shots. As with perforating gun 312 of FIG. 3, the gun 730 has an associated charge that detonates in order to cause shots to be fired into the surrounding production casing 750. Typically, the perforating gun 730 contains a string of shaped charges distributed along the length of the gun and oriented according to desired specifications.

The autonomous tool 700' optionally also includes a fishing neck 705. The fishing neck 705 is dimensioned and configured to serve as the male portion to a mating downhole fishing tool (not shown). The fishing neck 705 allows the operator to retrieve the autonomous tool 700 in the unlikely event that it becomes stuck in the wellbore 700' or the perforating gun 730 fails to detonate.

The autonomous tool 700' further includes an on-board controller 716. The on-board controller 716 processes the depth signals generated by the position locator 714. In one aspect, the on-board controller 716 compares the generated signals with a pre-determined physical signature obtained for the wellbore objects. For example, a CCL log may be run before deploying the autonomous tool 700 in order to determine the spacing of the casing collars 754. The corresponding depths of the casing collars 754 may be determined based on the length and speed of the wireline pulling a CCL logging device.

Upon determining that the autonomous tool 700' has arrived at the selected depth, the on-board controller 716 activates the setting tool 720. This causes the plug body 710 to be set in the wellbore 750 at a desired depth or location.

FIG. 7B is a side view of the wellbore of FIG. 7A. Here, the autonomous tool 700" has reached a selected depth. The selected depth is indicated at bracket 775. The on-board controller 716 has sent a signal to the setting tool 720" to actuate the elastomeric ring 711" and slips 713" of the plug body 710'.

In FIG. 7B, the plug body 710" is shown in an expanded state. In this respect, the elastomeric sealing element 711" is expanded into sealed engagement with the surrounding production casing 752, and the slips 713" are expanded into mechanical engagement with the surrounding production casing 752. The sealing element 711" offers a sealing ring, while the slips 713" offer grooves or teeth that "bite" into the inner diameter of the casing 750.

After the autonomous tool 700" has been set, the on-board controller 716 sends a signal to ignite charges in the perforating gun 730. The perforating gun 730 creates perforations through the production casing 752 at the selected depth 775. Thus, in the arrangement of FIGS. 7A and 7B, the setting tool 720 and the perforating gun 730 together define an actuatable tool.

The autonomous tools and methods are shown and described herein in the context of wellbore completions. In most applications, no wireline or coiled tubing operations are needed until final well cleanout. However, autonomous tools and methods may be employed with equal application in the context of fluid pipeline operations. In this instance, the tool may be a pig having a location device.

The above-described tools and methods concern an autonomous tool, that is, a tool that is not mechanically controlled from the surface. However, inventions are also disclosed herein using related but still novel technology, wherein a tool assembly is run into a wellbore on a working line.

In one aspect, the tool assembly includes an actuatable tool. The actuatable tool is configured to be run into a wellbore on a working line. The wellbore may be constructed to produce hydrocarbon fluids from a subsurface formation. Alternatively, the wellbore may be constructed to inject fluids into a subsurface formation. In either aspect, the working line may be a slickline, a wireline, or an electric line.

The tool assembly also includes a location device. The location device serves to sense the location of the actuatable tool within the wellbore based on a physical signature provided along the wellbore. The location device and corresponding physical signature may operate in accordance with the embodiments described above for the autonomous tool assemblies 200' (of FIG. 2) and 300' (of FIG. 3). For example, the location device may be a collar locator, and the signature is formed by the spacing of collars along the tubular body, with the collars being sensed by the collar locator.

The tool assembly further includes an on-board controller. The on-board controller is configured to send an actuation signal to the tool when the location device has recognized a selected location of the tool based on the physical signature. The actuatable tool is designed to be actuated to perform the wellbore operation in response to the actuation signal.

In one embodiment, the actuatable tool further comprises a detonation device. In this embodiment, the tool assembly is fabricated from a friable material. The on-board controller is further configured to send a detonation signal to the detonation device a designated time after the on-board controller is armed. Alternatively, the tool assembly self-destructs in response to the actuation of the actuatable tool. This may apply where the actuatable tool is a perforating gun. In either instance, the tool assembly is self-destructing.

In one arrangement, the actuatable tool is a fracturing plug. The fracturing plug is configured to form a substantial fluid seal when actuated within the tubular body at the selected location. The fracturing plug comprises an elastomeric sealing element and a set of slips for holding the location of the tool assembly proximate the selected location.

In another arrangement, the actuatable tool is a bridge plug. Here, the bridge plug is configured to form a substantial fluid seal when actuated within the tubular body at the selected location. The tool assembly is fabricated from a millable material. The bridge plug comprises an elastomeric sealing element and a set of slips for holding the location of the tool assembly proximate the selected location.

Other tools may serve as the actuatable tool. These may include a casing patch and a cement retainer. These tools may be fabricated from a millable material, such as ceramic, phenolic, composite, cast iron, brass, aluminum, or combinations thereof.

Figure 8A:
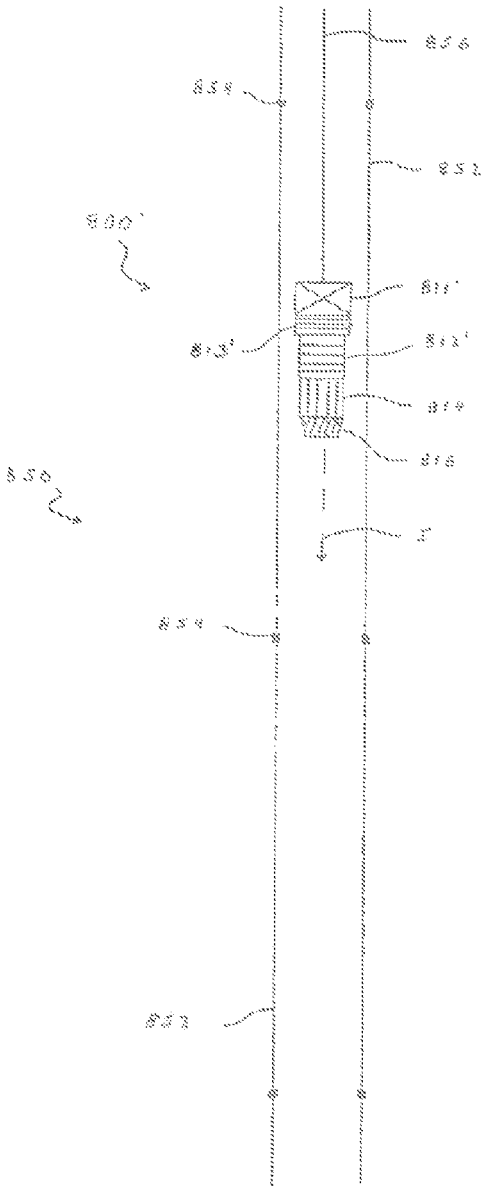
FIGS. 8A and 8B present side views of an illustrative tool assembly for performing a wellbore operation. The tool assembly is a perforating plug assembly being run into a wellbore on a working line.
Figure 8B:
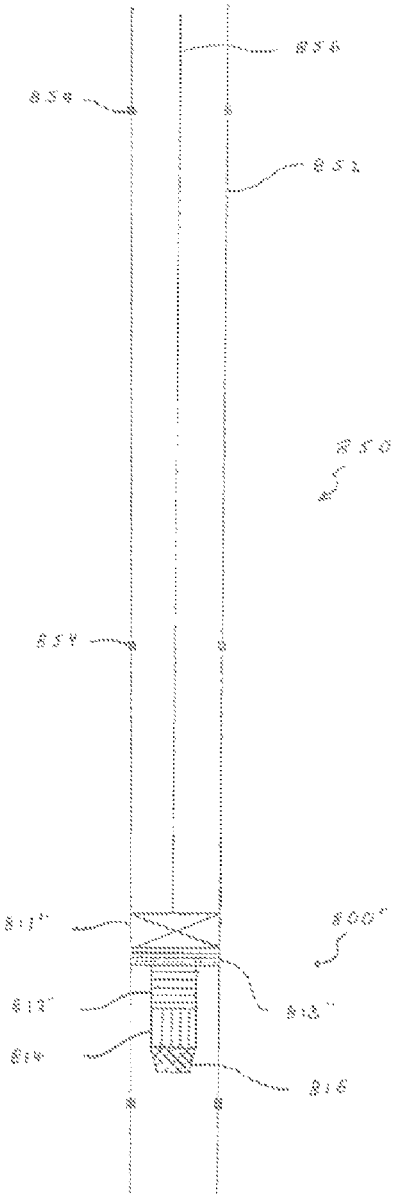

FIGS. 8A and 8B present side views of an illustrative tool assembly 800'/800" for performing a wellbore operation. Here, the tool assembly 800'/800" is a perforating plug assembly. In FIG. 8A, the fracturing plug assembly 800' is seen in its run-in or pre-actuated position; in FIG. 8B, the fracturing plug assembly 800" is seen in its actuated state.

Referring first to FIG. 8A, the fracturing plug assembly 800' is deployed within a string of production casing 850. The production casing 850 is formed from a plurality of "joints" 852 that are threadedly connected at collars 854. A wellbore completion operation is being undertaken, that includes the injection of fluids into the production casing 850 under high pressure. Arrow "I" indicates the movement of the fracturing plug assembly 800' in its pre-actuated position, down to a location in the production casing 850 where the fracturing plug assembly 800" will be actuated set.

The fracturing plug assembly 800' first includes a plug body 810'. The plug body 810' will preferably define an elastomeric sealing element 811' and a set of slips 813'. The elastomeric sealing element 811' and the slips 813' are generally in accordance with the plug body 210' described in connection with FIG. 2, above.

The fracturing plug assembly 800' also includes a setting tool 812'. The setting tool 812' will actuate the slips 813' and the elastomeric sealing element 811' and translate them along wedges (not shown) to contact the surrounding casing 850. In the actuated position for the plug assembly 800", the plug body 810" is shown in an expanded state. In this respect, the elastomeric sealing element 811" is expanded into sealed engagement with the surrounding production casing 850, and the slips 813" are expanded into mechanical engagement with the surrounding production casing 850. The sealing element 811" comprises a sealing ring, while the slips 813" offer grooves or teeth that "bite" into the inner diameter of the casing 850. Thus, in the tool assembly 800", the plug body 810" consisting of the sealing element 811" and the slips 813" define the actuatable tool.

The fracturing plug assembly 800' also includes a position locator 814. The position locator 814 serves as a location device for sensing the location of the tool assembly 800' within the production casing 850. More specifically, the position locator 814 senses the presence of objects or "tags" along the wellbore 850, and generates depth signals in response.

In the view of FIGS. 8A and 8B, the objects are the casing collars 854. This means that the position locator 814 is a casing collar locator, or "CCL." The CCL senses the location of the casing collars 854 as it moves down the production casing 850. While FIG. 8A presents the position locator 814 as a CCL and the objects as casing collars, it is understood that other sensing arrangements may be employed in the fracturing plug assembly 800' as discussed above.

The fracturing plug assembly 800' further includes an on-board controller or processor 816. The on-board controller 816 processes the depth signals generated by the position locator 814. In one aspect, the on-board controller 816 compares the generated signals with a pre-determined physical signature obtained for wellbore objects. For example, a CCL log may be run before deploying the autonomous tool (such as the fracturing plug assembly 800') in order to determine the spacing of the casing collars 854. The corresponding depths of the casing collars 854 may be determined based on the length and speed of the wireline pulling a CCL logging device.

The on-board controller 816 activates the actuatable tool when it determines that the tool assembly 200" has arrived at a particular depth adjacent a selected zone of interest. In the example of FIG. 8B, the on-board controller 816 activates the fracturing plug 810" and the setting tool 812" to cause the fracturing plug assembly 800" to stop moving, and to set in the production casing 850 at a desired depth or location.

The tool assembly 800'/800" of FIGS. 8A and 8B differs from the autonomous tools 200' and 300' of FIGS. 2 and 3 in that the tool assembly 800'/800", including autonomous tool components therewith, may be run into the wellbore 850 on a working line 856. In the illustrative arrangement of FIGS. 8A and 8B, the working line 856 may be a slickline. However, the working line 856 may alternatively be an electric line.

In one embodiment, the tool assembly may be run into the wellbore with a tractor. This is particularly advantageous is deviated wellbores. In this embodiment, the on-board processor may be (i) configured to send an actuation signal to the tool when the location device has recognized the selected location of the tool based on the physical signature, and (ii) have a timer for self-destructing the tool assembly at a predetermined time after the tool assembly is set in the tubular body. The tool assembly would be fabricated from a friable material.

In another embodiment, the working line may be an electric line or slickline, and the tool assembly still include an autonomously actuatable detonation device, such as to set a tool or self-destruct a tool. In some embodiments, the on-board processor may be configured to receive an actuation signal through the electric line for actuating the actuatable tool and perform the wellbore operation. Further, in either the slickline or electric line embodiment, the on-board processor may have a timer for autonomously self-destructing all or parts of the tool assembly using a detonation device at a predetermined period of time after the tool assembly is actuated in the wellbore. In some such embodiments, the actuatable tool is a fracturing plug or a bridge plug.

Still other embodiments of the claimed subject matter include apparatus and methods for autonomously performing a tubular body or wellbore operation, such as a pipeline pigging operation or a wellbore completion operation whereby the wellbore is constructed to produce (including injection and disposal operations as operations ultimately related to production operations) hydrocarbon fluids from a subsurface formation or to inject fluids into a subsurface formation. In one aspect, the method may first comprise deploying or running an autonomous tool assembly into the wellbore, such as by gravity, pumping, or on a working line, such as a slickline, wireline, or electric line that doesn't directly contribute to or facilitate the autonomous tool functions.

The tool assembly and methods include an actuatable tool. The actuatable tool may be, for example, a fracturing plug, a cement retainer, or a bridge plug. The tool assembly may also include an actuating or setting tool for actuating or setting the tool assembly, either partially or fully. The tool assembly may further include an autonomously activated detonation device to facilitate actuation and/or destruction of the tool, preferably destroying at least a friable portion of the tool. Still further, the tool assembly includes an on-board processor. The on-board processor has a timer for self-destructing the tool assembly using the detonation device at a predetermined period of time after the tool is actuated in the wellbore. The tool assembly is fabricated from a destructible material, preferably a friable, drillable, or millable material, to aid in self-destruction. The method may also include removing the working line after the tool assembly is set in the wellbore.

In one embodiment, the tool assembly further comprises a location device for sensing the location of the actuatable tool within the wellbore based on a physical signature provided along the wellbore. In this embodiment, the onboard processor is configured to send an actuation signal to the tool when the location device has recognized a selected location of the tool based on the physical signature. The actuatable tool is designed to be actuated to perform the wellbore operation in response to the actuation signal.

In another embodiment, the tool assembly further comprises a set of slips for holding the tool assembly in the wellbore. The slips may merely hold the tool in position while allowing fluid circulation past the tool or may hold the tool in position including hydraulic sealing and isolation. The actuation signal actuates the slips to cause the tool assembly to be set and/or positioned in the wellbore at the selected location. Further, the on-board processor sends a signal to the detonation device a predetermined period of time after the tool assembly is set in the wellbore to self-destruct the tool assembly. The actuatable tool may be a bridge plug or a fracturing plug.

Figure 9A:
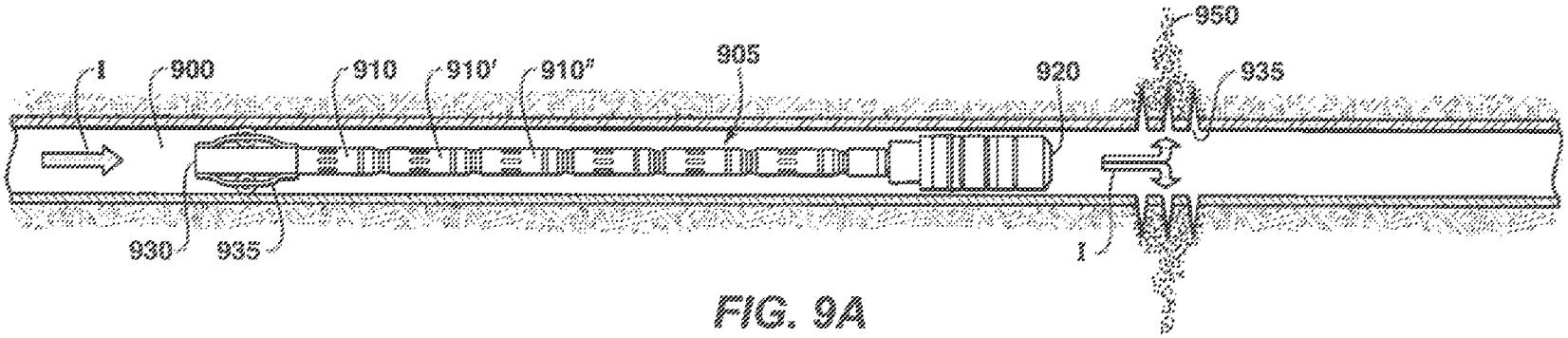
FIG. 9A illustrates a tool assembly autonomously moving downhole along a wellbore.

The improved methods and apparatus provided herein may further include an autonomous system that can be used to deliver multiple perforating guns (including multiple stages within a single gun, such as with a select fire type of gun) in a single trip, and optionally an additional tool such as a bridge plug or fracturing plug. In other embodiments, one gun may be associated with or engaged with another tool, such as a bridge plug, while other guns are independently deployed and autonomously actuated at selected locations within the wellbore. FIGS. 9A through 9D and FIG. 10 illustrate some exemplary embodiments of such inventive methods. FIG. 9A illustrates a wellbore 900 having an autonomous tool assembly 905 including a plug 920, perforating guns 910, 910', 910" (such as set of select fire guns or multiple individual sets of single stage perforating guns which in turn may be coupled or conveyed sequentially), and a location device 930 such as a casing collar locator, logging tool, or other position sensor. The tool assembly 905 may also optionally include other devices, such as centralizers, tractors, etc., 935. The tool assembly 905 may be autonomously conveyed such as by gravity, tractor, pumping using a wellbore fluid "I", whereby fluid ahead of the tool assembly "I" may be displaced or injected into previously perforated and stimulated zone 950, or combinations thereof.

Figure 9B:
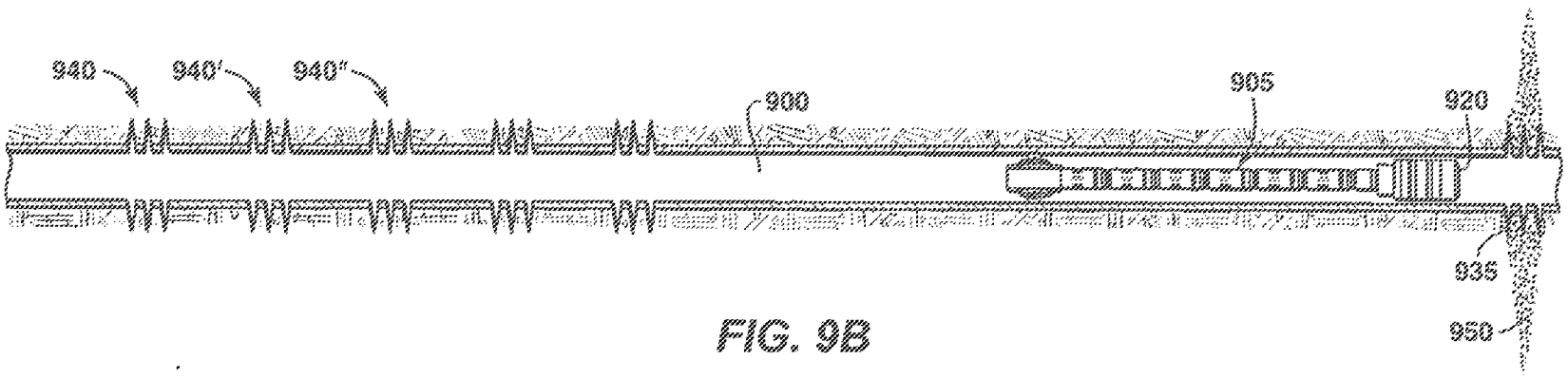
FIG. 9B illustrates the tool assembly of FIG. 9A selectively shooting perforations as the tool assembly passes selected points within the wellbore.

FIG. 9B illustrates an exemplary step of autonomously firing one or more sets of perforations 940, 940', 940" as the perforating gun(s) 910, 910', 910" move downhole and pass selected intervals for perforating. For example, this process and apparatus may be used in creating cluster perforations. The assembly may include a single perforating gun or include multiple guns or gun stages. Deployment may be as a combined unit or as separate, individually deployed units. Such autonomous perforating may be performed as the guns are pumped or gravitationally, tractored or otherwise conveyed past the selected perforation intervals. A cluster of perforations 940, 940', and 940" may be shot from shallower within the wellbore to deeper within the wellbore, or beginning from deeper depths and then subsequently shoot shallower perforations.

Such methods and tools assemblies as illustrated in FIG. 9B may facilitate completing and stimulating numerous sequential intervals or stages of the wellbore and formation from the wellbore toe back toward the wellbore heel or uphole, without requiring use of wirelines and wireline tools, etc. or requiring tubular conveyance of completion stage equipment.

Figure 9C:
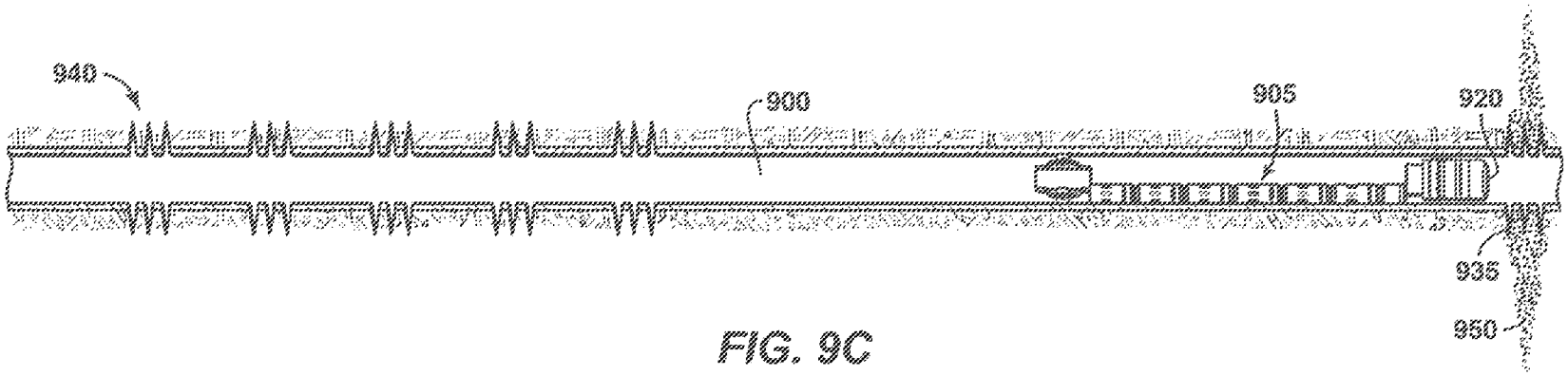
FIG. 9C illustrates the tool assembly of FIGS. 9A and 9B selectively actuating and setting a plug assembly as the tool assembly reaches a selected point within the wellbore, prior to stimulating the perforations shot in illustration FIG. 9B.

Referring now to FIG. 9C, the plug 920 may be set before or often more preferably after completion of perforations, 940, 940', 940" to enable movement of the guns by hydraulic pumping of fluid into the wellbore. The guns (optionally including the controller on each gun) may self destruct during firing, or self-destruct subsequent to all guns being fired, in a separate self-destruction action. For embodiments where the guns are conveyed with the plug, the guns may be selectively disengaged from the plug and/or self-destructed following setting the plug. The stimulation or testing of the perforations 940, 940', 940" may commence to create stimulated zones 980, 980', 980" as illustrated in FIG. 9D.

Stimulation of all the perforations may occur substantially simultaneously or may be staged such as for example by use of ball sealers for diversion.

Figure 9D:
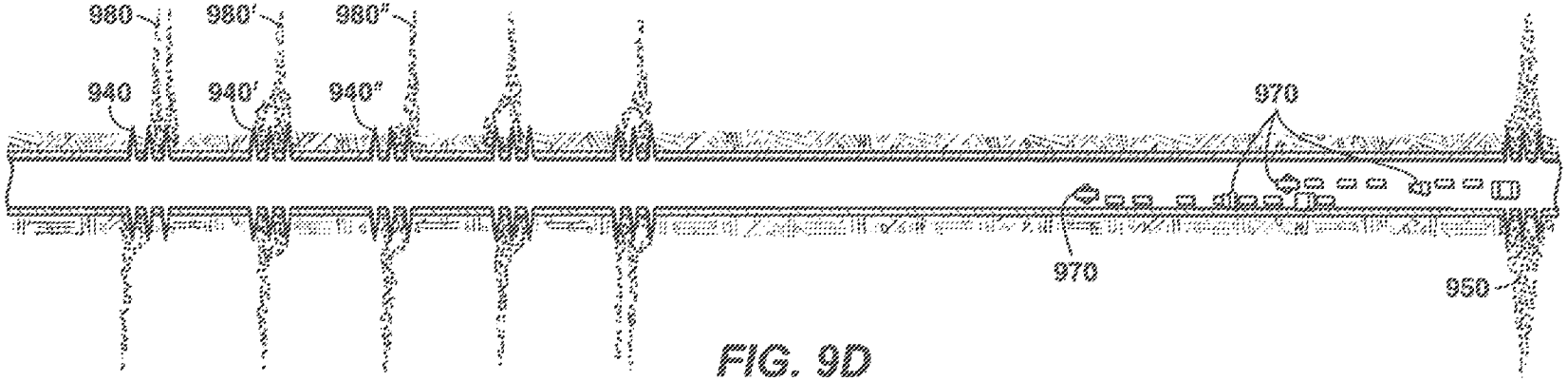
FIG. 9D illustrates destruction of the plug and perforating gun tool assembly following the stimulation illustrated in FIG. 9C.

Referring to FIG. 9D, at the appropriately designated time, plug 920 and/or the gun assembly 910, 910', 910" may be autonomously or non-autonomously to self destruct or be otherwise removed or disintegrated to cause completion 950 with completions 940, 940', and 940". The guns 910, controllers 930, plug and related debris 970 may be hydraulically displaced into downhole completions, or mechanically pushed downhole, milled away, or otherwise circulated out of the hole such as with foamed nitrogen using coil tubing.

After the plug or plug/gun assembly reaches the designated depth and all of the guns have been fired, the bridge plug is preferably set autonomously. At this time, the stimulation of the newly perforated zone 940, 940', and 940" can be initiated. Upon completion of the stimulation, if the guns were not destroyed during perforating activity, the guns and/or plugs can be self-destroyed such as by internal destruct charge and the debris removed.

Figure 10:
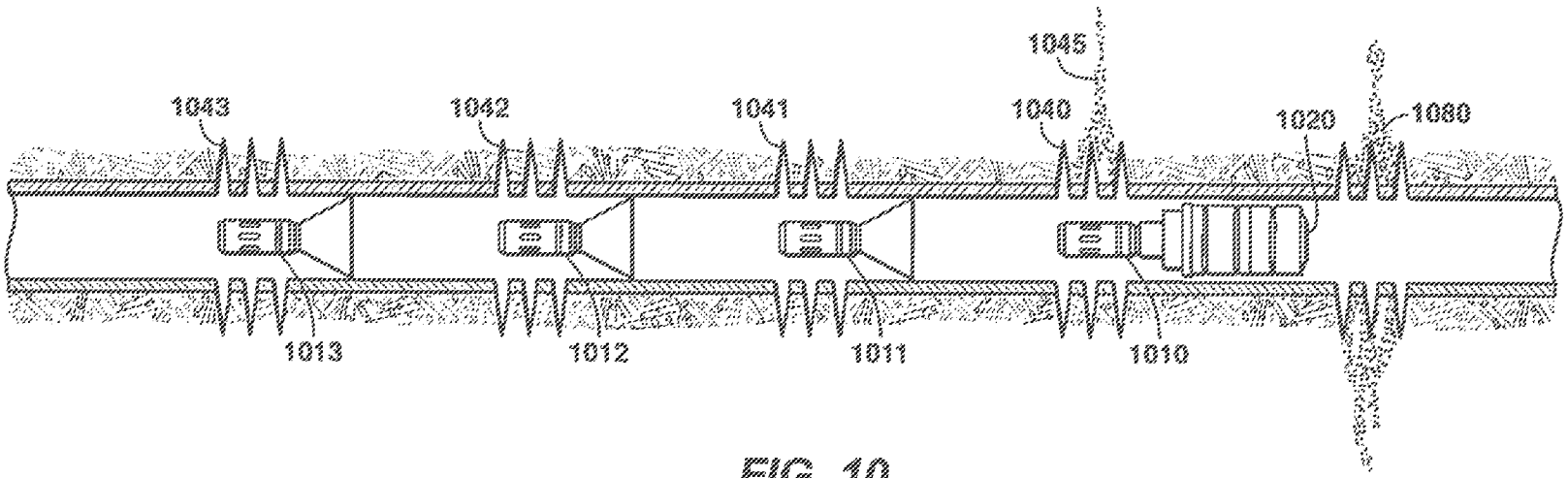
FIG. 10 presents an illustration of an embodiment where the autonomous tool includes multiple perforating guns or stages, each independently and autonomously actuatable, including a first gun that is deployed in conjunction with an autonomously settable plug.

In yet another variation of the methods and apparatus discussed above and exemplified in FIGS. 9A through 9D and further illustrated in exemplary FIG. 10, the plug 1020 may be connected or conveyed downhole with a first perforating gun or set of select fire guns, 1010 and controller (including locator), which may autonomously shoot a first set of perforations 1040. (Note that the relative term downhole refers toward the toe or bottom of the wellbore, while the relative term uphole refers toward the surface of the wellbore.) After shooting the first new set of perforations 1040, the plug 1020 may be autonomously set at a desired location, such as above previous perforations 1080 or otherwise moveably retained at a desired location such as with a casing seat ring, or with a set of slips that halts plug movement but whereby the plug does not activate a seal element, such that fluid may continue to bypass the plug to continue flowing into previous perforations or completion 1050. Alternatively, the plug 1020 may be autonomously set at the desired location to cause further wellbore fluid movement 1045 (such as acid or wellbore fluid such as slick water, gelled fluid, or crosslinked fluid) to exit the wellbore through new perforations 1040.

Thereafter, subsequent perforating guns or sets of guns, 1011, 1012, 1013 and controller may be pumped, gravitationally displaced, or tractored along the wellbore (either untethered or with a wire or slick line), past the desired perforation zone and autonomously fired at the designated interval to create additional perforations 1041, 1042, and 1043. The new perforations may be stimulation treated after all perforations have been shot, or each new cluster of perforations may be stimulated or broken open prior to shooting the subsequent cluster or set of perforations. The guns may be autonomously self destructed in combination with perforating or subsequently, as discussed previously.

In some wells, such as horizontal wells, conveying, pumping or dropping the guns and controller (or plug or other autonomously actuatable tool) to the selected firing interval may be enhanced by use of a cup, fins, or other apparatus that enhance tool movement through or with wellbore fluid. Such apparatus and methods may even enable use of a low-viscosity wellbore fluid, such as slickwater, that may otherwise be relatively inefficient at hydraulically conveying tools. The tools may be enhance by providing a cup and/or fins engaged with the gun or tool assembly, such as illustrated in exemplary FIG. 10. Thereby, the guns may be efficiently hydraulically conveyed along the wellbore.

FIG. 10 also illustrates an embodiment whereby on gun or set of guns may be associated with or engaged with an autonomously actuatable tool, such as a fracturing plug 1020. Subsequent intervals may be perforated with gun assemblies that are independently conveyed and autonomously actuated at the appropriate intervals. Preferably, all guns and plugs, etc., are sufficiently friable to enable autonomous destruction and cleanout after all perforating, stimulating, and testing is complete.

While it will be apparent that the inventions herein described are well calculated to achieve the benefits and advantages set forth above, it will be appreciated that the inventions are susceptible to modification, variation and change without departing from the spirit thereof.

What is claimed is:

1. A tool assembly for performing a tubular operation, comprising:

an actuatable tool configured to be run into a tubular body with a tractor, the actuatable tool including a friable container for holding a diversion material, the friable container configured to release the diversion material in response to actuation of the actuatable tool:

a controller comprising;

a location device for sensing the location of the actuatable tool within the tubular body based on a physical signature provided along the tubular body; and an on-board processor (i) configured to send an actuation signal to the tool when the location device has recognized a selected location within the tubular body based on the physical signature, the actuatable tool being designed to release the diversion material in response to a command from the on-board processor, and (ii) having a timer for self-destructing the tool assembly including the friable container at a predetermined period of time after the tool assembly releases the diversion materials.

2. The tool assembly of claim 1, wherein the tubular body is a wellbore constructed to produce hydrocarbon fluids from a subsurface formation or to inject fluids into a subsurface formation.

3. The tool assembly of claim 1, wherein:

the tubular body is a pipeline carrying fluids; and the actuatable tool is a pig.

4. A method for performing a wellbore completion operation, comprising:

running a tool assembly into a wellbore on a working line, the tool assembly being fabricated from a friable material, and the tool assembly comprising:

an actuatable tool, a setting tool, a detonation device, and an on-board processor with a timer for self-destructing the tool assembly using the detonation device at a predetermined period of time after the tool is actuated in the wellbore;

a friable container for transporting diversion materials, the friable container configured to release the diversion materials in response to a command from the on-board processor prior to at least one of actuating the actuatable tool and detonating the detonation device; and removing the working line after at least one of actuating the actuatable tool and detonating the detonation device.

5. The method of claim 4, wherein:

the wellbore is constructed to produce hydrocarbon fluids from a subsurface formation or to inject fluids into a subsurface formation; and the working line is (i) a slickline, (ii) a wireline, or (iii) an electric line.

6. A method for autonomously performing a subterranean wellbore operation, comprising:

providing an autonomously actuatable tool assembly comprising;

an actuatable tool comprising at least one of friable components;

a location device for sensing the location of the actuatable tool assembly within a wellbore based on a physical signature determined by the location device along the wellbore;

diversion materials;

a friable container for transporting the diversion materials; and a controller configured to send an actuation signal to the actuatable tool assembly in response to the physical signature when the location device determines an actuation location for the tool, and the controller configured to send a release signal to the friable container to cause release of the diversion materials from the container;

deploying the actuatable tool assembly in the wellbore as an autonomously actuatable unit; and autonomously actuating the actuatable tool in response to receipt by the tool of the actuation signal from the controller, to perform the wellbore operation and to release the diversion materials from the friable container.

7. The method of claim 6, wherein the actuatable tool includes a perforating gun and the method further comprising autonomously perforating a first set of perforations in the wellbore; and opening the first set of perforations to conduct a wellbore fluid from within the wellbore through the first set of perforations.

8. The method of claim 6, wherein the actuatable tool includes the autonomously actuatable plug mechanically engaged with an autonomously actuatable perforating gun and the method further comprises deploying the tool assembly within the wellbore and autonomously actuating the perforating gun in response to the actuation signal to create a set of perforations uphole from the plug.

9. The method of claim 8, further comprising conducting the step of autonomously actuating a perforating gun prior to setting the plug.

10. The method of claim 8, wherein the method of deploying the perforating gun includes deploying multiple perforating guns and the method further comprises autonomously actuating each gun to create multiple sets of perforations within the wellbore.

11. The method of claim 7, wherein the actuatable tool includes still another perforating gun and the method further comprises deploying the still another perforating gun engaged with the plug and autonomously firing the still another perforating gun in response to the actuation signal.

12. The method of claim 11, wherein the method of deploying the still another perforating gun includes deploying multiple perforating guns and the method further comprises autonomously and selectively actuating each gun to create multiple sets of perforations within the wellbore.

13. The method of claim 6, further comprising destroying at least the friable container portion of the tool assembly with the autonomously actuatable signal or another autonomously actuatable signal.

14. The method of claim 6, wherein the tool assembly comprises at least two perforating guns, each of the at least two perforating guns independently deployable within the wellbore and each of the at least two perforating guns independently autonomously actuatable in response to receipt by the each of the at least two perforating guns of a respective independent actuation signal causing independent autonomous actuation of a respective each of the at least two perforating guns.

15. The method of claim 6, providing cups or fins on the tool assembly to enhance deployment of the tool assembly within the wellbore.

16. The method of claim 6, wherein the actuatable tool comprises a friable material and the method comprises autonomously destroying at least a portion of the friable material in response to a designated event.

* * * * *